US007500368B2

(12) United States Patent
Mowris

(10) Patent No.: US 7,500,368 B2
(45) Date of Patent: Mar. 10, 2009

(54) SYSTEM AND METHOD FOR VERIFYING PROPER REFRIGERANT AND AIRFLOW FOR AIR CONDITIONERS AND HEAT PUMPS IN COOLING MODE

(76) Inventor: Robert James Mowris, P.O. Box 2141, Olympic Valley, CA (US) 96146

( * ) Notice: Subject to any disclaimer, the term of this patent is extended or adjusted under 35 U.S.C. 154(b) by 495 days.

(21) Appl. No.: 11/152,302

(22) Filed: Jun. 14, 2005

(65) Prior Publication Data

US 2006/0117767 A1 Jun. 8, 2006

Related U.S. Application Data

(60) Provisional application No. 60/611,054, filed on Sep. 17, 2004.

(51) Int. Cl.
*F25B 45/00* (2006.01)

(52) U.S. Cl. ..... 62/149; 62/292; 62/324.4

(58) Field of Classification Search ..... 62/149, 62/292, 324.4; 236/51
See application file for complete search history.

(56) References Cited

U.S. PATENT DOCUMENTS

| | | | | |
|---|---|---|---|---|
| 3,791,165 | A * | 2/1974 | Honnold et al. | 62/77 |
| 6,220,041 | B1 * | 4/2001 | Okazaki et al. | 62/149 |
| 6,571,566 | B1 * | 6/2003 | Temple et al. | 62/129 |
| 6,612,455 | B2 | 9/2003 | Byrne | |
| 6,981,384 | B2 * | 1/2006 | Dobmeier et al. | 62/149 |
| 2006/0137366 | A1 * | 6/2006 | Kang et al. | 62/149 |

* cited by examiner

*Primary Examiner*—Marc E Norman
(74) *Attorney, Agent, or Firm*—Kenneth L. Green; Edgar W. Averill, Jr.

(57) ABSTRACT

An apparatus for the diagnosis of a cooling system which receives inputs in the form of data about a cooling system, and measurements made from the cooling system, and which then calculates the amount of refrigerant to be removed or added to the cooling system for optimal performance. In addition, methods for ensuring correct setup of a cooling system are disclosed. The methods may apply to FXV (fixed expansion valve) systems and may include making and displaying a prediction of a refrigerant adjustment based upon measurements such as return air wetbulb temperature, condenser air entering temperature, refrigerant superheat vapor line temperature, and refrigerant superheat vapor line pressure. A method for ensuring correct setup of a cooling system is disclosed. The method may apply to TXV (thermostatic expansion valve) systems and may include making and displaying a prediction of a refrigerant adjustment based upon measurements such as refrigerant subcooling liquid line temperature and refrigerant subcooling liquid line pressure. A method for ensuring correct setup of a cooling system is disclosed. The method may include making and displaying a prediction of a refrigerant adjustment or of an airflow adjustment based upon measurements such as return air wetbulb temperature, return air drybulb temperature and supply air drybulb temperature. Recommendations may also be based upon evaporator coil temperature splits. Methods for visual identification, archiving of associated measurement and verification data, and viewing of data for a correct setup of a cooling system are disclosed. Methods of maintaining correct setup of a cooling system through use of labels and locking, double-sealing, color-coded, and laser etched Schrader caps are disclosed.

25 Claims, 37 Drawing Sheets

804

| 3.1.3 Indoor Entering Air Dry-Bulb Temperature (°F) | 3.1.2 Indoor Entering Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 60 | 17.4 | 17.2 | 17.1 | 16.9 | 16.6 | 16.4 | 16.0 | 15.6 | 15.2 | 14.7 | 14.2 | | | | | | | | | | | | | | | | | 60 |
| 61 | 17.7 | 17.5 | 17.4 | 17.2 | 16.9 | 16.7 | 16.3 | 15.9 | 15.5 | 15.0 | 14.5 | 14.0 | | | | | | | | | | | | | | | | 61 |
| 62 | 18.0 | 17.8 | 17.7 | 17.5 | 17.2 | 17.0 | 16.6 | 16.2 | 15.8 | 15.3 | 14.8 | 14.3 | 13.7 | | | | | | | | | | | | | | | 62 |
| 63 | 18.3 | 18.1 | 18.0 | 17.8 | 17.5 | 17.3 | 16.9 | 16.5 | 16.1 | 15.6 | 15.1 | 14.6 | 13.9 | 13.3 | | | | | | | | | | | | | | 63 |
| 64 | 18.6 | 18.4 | 18.3 | 18.1 | 17.8 | 17.6 | 17.2 | 16.8 | 16.4 | 15.9 | 15.4 | 14.9 | 14.2 | 13.6 | 12.9 | | | | | | | | | | | | | 64 |
| 65 | 18.9 | 18.7 | 18.6 | 18.4 | 18.1 | 17.9 | 17.5 | 17.1 | 16.7 | 16.2 | 15.7 | 15.2 | 14.5 | 13.9 | 13.2 | 12.5 | | | | | | | | | | | | 65 |
| 66 | 19.3 | 19.1 | 19.0 | 18.8 | 18.5 | 18.3 | 17.9 | 17.5 | 17.1 | 16.6 | 16.1 | 15.6 | 14.9 | 14.3 | 13.6 | 12.8 | 12.0 | | | | | | | | | | | 66 |
| 67 | 19.7 | 19.5 | 19.4 | 19.2 | 18.9 | 18.7 | 18.3 | 17.9 | 17.5 | 17.0 | 16.5 | 16.0 | 15.3 | 14.7 | 14.0 | 13.2 | 12.5 | 11.5 | | | | | | | | | | 67 |
| 68 | 20.1 | 19.9 | 19.8 | 19.6 | 19.3 | 19.1 | 18.7 | 18.3 | 17.9 | 17.4 | 16.9 | 16.4 | 15.7 | 15.1 | 14.4 | 13.6 | 12.9 | 12.0 | 11.0 | | | | | | | | | 68 |
| 69 | 20.5 | 20.3 | 20.2 | 20.0 | 19.7 | 19.5 | 19.1 | 18.7 | 18.3 | 17.8 | 17.3 | 16.8 | 16.1 | 15.5 | 14.8 | 14.0 | 13.3 | 12.4 | 11.5 | 10.5 | | | | | | | | 69 |
| 70 | 20.9 | 20.7 | 20.6 | 20.4 | 20.1 | 19.9 | 19.5 | 19.1 | 18.7 | 18.2 | 17.7 | 17.2 | 16.5 | 15.9 | 15.2 | 14.4 | 13.7 | 12.8 | 11.9 | 11.0 | 10.0 | | | | | | | 70 |
| 71 | 21.4 | 21.3 | 21.1 | 20.9 | 20.7 | 20.4 | 20.1 | 19.7 | 19.3 | 18.8 | 18.3 | 17.7 | 17.1 | 16.4 | 15.7 | 15.0 | 14.2 | 13.4 | 12.5 | 11.5 | 10.6 | 9.5 | | | | | | 71 |
| 72 | 21.9 | 21.8 | 21.7 | 21.5 | 21.2 | 20.9 | 20.6 | 20.2 | 19.8 | 19.3 | 18.8 | 18.2 | 17.6 | 17.0 | 16.3 | 15.5 | 14.7 | 13.9 | 13.0 | 12.1 | 11.1 | 10.1 | 9.0 | | | | | 72 |
| 73 | 22.5 | 22.4 | 22.2 | 22.0 | 21.8 | 21.5 | 21.2 | 20.8 | 20.3 | 19.9 | 19.4 | 18.8 | 18.2 | 17.5 | 16.8 | 16.1 | 15.3 | 14.4 | 13.6 | 12.6 | 11.7 | 10.6 | 9.6 | 8.5 | | | | 73 |
| 74 | 23.0 | 22.9 | 22.8 | 22.6 | 22.3 | 22.0 | 21.7 | 21.3 | 20.9 | 20.4 | 19.9 | 19.3 | 18.7 | 18.1 | 17.4 | 16.6 | 15.8 | 15.0 | 14.1 | 13.2 | 12.2 | 11.2 | 10.1 | 9.0 | 7.8 | | | 74 |
| 75 | 23.6 | 23.5 | 22.3 | 23.1 | 22.9 | 22.6 | 22.2 | 21.9 | 21.4 | 21.0 | 20.4 | 19.9 | 19.3 | 18.6 | 17.9 | 17.2 | 16.4 | 15.5 | 14.7 | 13.7 | 12.7 | 11.7 | 10.7 | 9.5 | 8.4 | 7.2 | | 75 |
| 76 | 24.1 | 24.0 | 23.9 | 23.7 | 23.4 | 23.1 | 22.8 | 22.4 | 22.0 | 21.5 | 21.0 | 20.4 | 19.8 | 19.2 | 18.5 | 17.7 | 16.9 | 16.1 | 15.2 | 14.3 | 13.3 | 12.3 | 11.2 | 10.1 | 8.9 | 7.7 | 6.5 | 76 |
| 77 | | 24.6 | 24.4 | 24.2 | 24.0 | 23.7 | 23.3 | 22.9 | 22.5 | 22.0 | 21.5 | 21.0 | 20.4 | 19.7 | 19.0 | 18.3 | 17.5 | 16.6 | 15.7 | 14.8 | 13.8 | 12.8 | 11.7 | 10.6 | 9.5 | 8.3 | 7.0 | 77 |
| 78 | | | | 24.7 | 24.5 | 24.2 | 23.9 | 23.5 | 23.1 | 22.6 | 22.1 | 21.5 | 20.9 | 20.2 | 19.5 | 18.8 | 18.0 | 17.2 | 16.3 | 15.4 | 14.4 | 13.4 | 12.3 | 11.2 | 10.0 | 8.8 | 7.6 | 78 |
| 79 | | | | | | 24.8 | 24.4 | 24.0 | 23.6 | 23.1 | 22.6 | 22.1 | 21.4 | 20.8 | 20.1 | 19.3 | 18.5 | 17.7 | 16.8 | 15.9 | 14.9 | 13.9 | 12.8 | 11.7 | 10.6 | 9.4 | 8.1 | 79 |
| 80 | | | | | | | 25.0 | 24.6 | 24.2 | 23.7 | 23.2 | 22.6 | 22.0 | 21.3 | 20.6 | 19.9 | 19.1 | 18.3 | 17.4 | 16.4 | 15.5 | 14.4 | 13.4 | 12.3 | 11.1 | 9.9 | 8.7 | 80 |
| 81 | | | | | | | | 25.1 | 24.7 | 24.2 | 23.7 | 23.1 | 22.5 | 21.9 | 21.2 | 20.4 | 19.6 | 18.8 | 17.9 | 17.0 | 16.0 | 15.0 | 13.9 | 12.8 | 11.7 | 10.4 | 9.2 | 81 |
| 82 | | | | | | | | | 25.2 | 24.8 | 24.2 | 23.7 | 23.1 | 22.4 | 21.7 | 21.0 | 20.2 | 19.3 | 18.5 | 17.5 | 16.6 | 15.5 | 14.5 | 13.4 | 12.2 | 11.0 | 9.7 | 82 |
| 83 | | | | | | | | | | 25.3 | 24.8 | 24.2 | 23.6 | 23.0 | 22.3 | 21.5 | 20.7 | 19.9 | 19.0 | 18.1 | 17.1 | 16.1 | 15.0 | 13.9 | 12.7 | 11.5 | 10.3 | 83 |
| 84 | | | | | | | | | | 25.9 | 25.2 | 24.8 | 24.2 | 23.5 | 22.8 | 22.1 | 21.3 | 20.4 | 19.5 | 18.6 | 17.6 | 16.6 | 15.6 | 14.4 | 13.3 | 12.5 | 10.8 | 84 |

*FIG. 14*

| 3.2.3 Outdoor Condenser Entering Air Dry-Bulb Temperature (°F) | 3.2.2 Indoor Entering Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 55 | 8.8 | 10.1 | 11.5 | 12.8 | 14.2 | 15.6 | 17.1 | 18.5 | 20 | 21.5 | 23.1 | 24.6 | 26.2 | 27.8 | 29.4 | 31 | 32.4 | 33.8 | 35.1 | 36.4 | 37.7 | 39 | 40.2 | 41.5 | 42.7 | 43.9 | 45 | 55 |
| 56 | 8.6 | 9.9 | 11.2 | 12.6 | 14 | 15.4 | 16.8 | 18.2 | 19.7 | 21.2 | 22.7 | 24.2 | 25.7 | 27.3 | 28.9 | 30.5 | 31.8 | 33.2 | 34.6 | 35.9 | 37.2 | 38.5 | 39.7 | 41 | 42.2 | 43.4 | 44.6 | 56 |
| 57 | 8.3 | 9.6 | 11 | 12.3 | 13.7 | 15.1 | 16.5 | 17.9 | 19.4 | 20.8 | 22.3 | 23.8 | 25.3 | 26.8 | 28.3 | 29.9 | 31.3 | 32.6 | 34 | 35.3 | 36.7 | 38 | 39.2 | 40.5 | 41.7 | 43 | 44.2 | 57 |
| 58 | 7.9 | 9.3 | 10.6 | 12 | 13.4 | 14.8 | 16.2 | 17.6 | 19 | 20.4 | 21.9 | 23.3 | 24.8 | 26.3 | 27.8 | 29.3 | 30.7 | 32.1 | 33.5 | 34.8 | 36.1 | 37.5 | 38.7 | 40 | 41.3 | 42.5 | 43.7 | 58 |
| 59 | 7.5 | 8.9 | 10.2 | 11.6 | 13 | 14.4 | 15.8 | 17.2 | 18.6 | 20 | 21.4 | 22.9 | 24.3 | 25.7 | 27.2 | 28.7 | 30.1 | 31.5 | 32.9 | 34.3 | 35.6 | 36.9 | 38.3 | 39.5 | 40.8 | 42.1 | 43.3 | 59 |
| 60 | 7 | 8.4 | 9.8 | 11.2 | 12.6 | 14 | 15.4 | 16.8 | 18.2 | 19.6 | 21 | 22.4 | 23.8 | 25.2 | 26.6 | 28.1 | 29.6 | 31 | 32.4 | 33.7 | 35.1 | 36.4 | 37.8 | 39.1 | 40.4 | 41.6 | 42.9 | 60 |
| 61 | 6.5 | 7.9 | 9.3 | 10.7 | 12.1 | 13.5 | 14.9 | 16.3 | 17.7 | 19.1 | 20.5 | 21.9 | 23.3 | 24.7 | 26.1 | 27.5 | 29 | 30.4 | 31.8 | 33.2 | 34.6 | 35.9 | 37.3 | 38.6 | 39.9 | 41.2 | 42.4 | 61 |
| 62 | 6 | 7.4 | 8.8 | 10.2 | 11.7 | 13.1 | 14.5 | 15.9 | 17.3 | 18.7 | 20.1 | 21.4 | 22.8 | 24.2 | 25.5 | 27 | 28.4 | 29.9 | 31.3 | 32.7 | 34.1 | 35.4 | 36.8 | 38.1 | 39.4 | 40.7 | 42 | 62 |
| 63 | 5.3 | 6.8 | 8.3 | 9.7 | 11.1 | 12.6 | 14 | 15.4 | 16.8 | 18.2 | 19.6 | 20.9 | 22.3 | 23.6 | 25 | 26.4 | 27.8 | 29.3 | 30.7 | 32.2 | 33.6 | 34.9 | 36.3 | 37.7 | 39 | 40.3 | 41.6 | 63 |
| 64 | <5 | 6.1 | 7.6 | 9.1 | 10.6 | 12 | 13.5 | 14.9 | 16.3 | 17.7 | 19 | 20.4 | 21.7 | 23.1 | 24.4 | 25.8 | 27.3 | 28.7 | 30.2 | 31.6 | 33 | 34.4 | 35.8 | 37.2 | 38.5 | 39.9 | 41.2 | 64 |
| 65 | <5 | 5.4 | 7 | 8.5 | 10 | 11.5 | 12.9 | 14.3 | 15.8 | 17.1 | 18.5 | 19.9 | 21.2 | 22.5 | 23.8 | 25.2 | 26.7 | 28.2 | 29.7 | 31.1 | 32.5 | 33.9 | 35.3 | 36.7 | 38.1 | 39.4 | 40.8 | 65 |
| 66 | <5 | <5 | 6.3 | 7.8 | 9.3 | 10.8 | 12.3 | 13.8 | 15.2 | 16.6 | 18 | 19.3 | 20.7 | 22 | 23.2 | 24.6 | 26.1 | 27.6 | 29.1 | 30.6 | 32 | 33.4 | 34.9 | 36.3 | 37.6 | 39 | 40.4 | 66 |
| 67 | <5 | <5 | 5.5 | 7.1 | 8.7 | 10.2 | 11.7 | 13.2 | 14.6 | 16 | 17.4 | 18.8 | 20.1 | 21.4 | 22.7 | 24.1 | 25.6 | 27.1 | 28.6 | 30.1 | 31.5 | 33 | 34.4 | 35.8 | 37.2 | 38.6 | 39.9 | 67 |
| 68 | <5 | <5 | <5 | 6.3 | 8 | 9.5 | 11.1 | 12.6 | 14 | 15.5 | 16.8 | 18.2 | 19.5 | 20.8 | 22.1 | 23.5 | 25 | 26.5 | 28 | 29.5 | 31 | 32.5 | 33.9 | 35.3 | 36.8 | 38.1 | 39.5 | 68 |
| 69 | <5 | <5 | <5 | 5.5 | 7.2 | 8.8 | 10.4 | 11.9 | 13.4 | 14.8 | 16.3 | 17.6 | 19 | 20.3 | 21.5 | 22.9 | 24.4 | 26 | 27.5 | 29 | 30.5 | 32 | 33.4 | 34.9 | 36.3 | 37.7 | 39.1 | 69 |
| 70 | <5 | <5 | <5 | <5 | 6.4 | 8.1 | 9.7 | 11.2 | 12.7 | 14.2 | 15.7 | 17 | 18.4 | 19.7 | 20.9 | 22.3 | 23.9 | 25.4 | 27 | 28.5 | 30 | 31.5 | 33 | 34.4 | 35.9 | 37.3 | 38.7 | 70 |
| 71 | <5 | <5 | <5 | <5 | 5.6 | 7.3 | 8.9 | 10.5 | 12.1 | 13.6 | 15 | 16.4 | 17.8 | 19.1 | 20.3 | 21.7 | 23.3 | 24.9 | 26.4 | 28 | 29.5 | 31 | 32.5 | 34 | 35.4 | 36.9 | 38.3 | 71 |
| 72 | <5 | <5 | <5 | <5 | <5 | 6.4 | 8.1 | 9.8 | 11.4 | 12.9 | 14.4 | 15.8 | 17.2 | 18.5 | 19.7 | 21.2 | 22.8 | 24.3 | 25.9 | 27.4 | 29 | 30.5 | 32 | 33.5 | 35 | 36.5 | 37.9 | 72 |
| 73 | <5 | <5 | <5 | <5 | <5 | 5.6 | 7.3 | 9 | 10.7 | 12.2 | 13.7 | 15.2 | 16.6 | 17.9 | 19.2 | 20.6 | 22.2 | 23.8 | 25.4 | 26.9 | 28.5 | 30 | 31.5 | 33.1 | 34.6 | 36 | 37.5 | 73 |
| 74 | <5 | <5 | <5 | <5 | <5 | <5 | 6.5 | 8.2 | 9.9 | 11.5 | 13.1 | 14.5 | 15.9 | 17.3 | 18.6 | 20 | 21.6 | 23.2 | 24.8 | 26.4 | 28 | 29.5 | 31.1 | 32.6 | 34.1 | 35.6 | 37.1 | 74 |
| 75 | <5 | <5 | <5 | <5 | <5 | <5 | 5.6 | 7.4 | 9.2 | 10.8 | 12.4 | 13.9 | 15.3 | 16.7 | 18 | 19.4 | 21.1 | 22.7 | 24.3 | 25.9 | 27.5 | 29.1 | 30.6 | 32.2 | 33.7 | 35.2 | 36.7 | 75 |
| 76 | <5 | <5 | <5 | <5 | <5 | <5 | <5 | 6.6 | 8.4 | 10.1 | 11.7 | 13.2 | 14.7 | 16.1 | 17.4 | 18.9 | 20.5 | 22.1 | 23.8 | 25.4 | 27 | 28.6 | 30.1 | 31.7 | 33.3 | 34.8 | 36.3 | 76 |
| 77 | <5 | <5 | <5 | <5 | <5 | <5 | <5 | 5.7 | 7.5 | 9.3 | 11 | 12.5 | 14 | 15.4 | 16.8 | 18.3 | 20 | 21.6 | 23.2 | 24.9 | 26.5 | 28.1 | 29.7 | 31.3 | 32.8 | 34.4 | 36 | 77 |
| 78 | <5 | <5 | <5 | <5 | <5 | <5 | <5 | <5 | 6.7 | 8.5 | 10.2 | 11.8 | 13.4 | 14.8 | 16.2 | 17.7 | 19.4 | 21.1 | 22.7 | 24.4 | 26 | 27.6 | 29.2 | 30.8 | 32.4 | 34 | 35.6 | 78 |
| 79 | <5 | <5 | <5 | <5 | <5 | <5 | <5 | <5 | 5.9 | 7.7 | 9.5 | 11.1 | 12.7 | 14.2 | 15.6 | 17.1 | 18.8 | 20.5 | 22.2 | 23.8 | 25.5 | 27.1 | 28.8 | 30.4 | 32 | 33.6 | 35.2 | 79 |
| 80 | <5 | <5 | <5 | <5 | <5 | <5 | <5 | <5 | <5 | 6.9 | 8.7 | 10.4 | 12 | 13.5 | 15 | 16.6 | 18.3 | 20 | 21.7 | 23.3 | 25 | 26.7 | 28.3 | 29.9 | 31.6 | 33.2 | 34.8 | 80 |
| 81 | <5 | <5 | <5 | <5 | <5 | <5 | <5 | <5 | <5 | 6 | 7.9 | 9.7 | 11.3 | 12.9 | 14.3 | 16 | 17.7 | 19.4 | 21.1 | 22.8 | 24.5 | 26.2 | 27.9 | 29.5 | 31.2 | 32.8 | 34.4 | 81 |
| 82 | <5 | <5 | <5 | <5 | <5 | <5 | <5 | <5 | <5 | 5.2 | 7.1 | 8.9 | 10.6 | 12.2 | 13.7 | 15.4 | 17.2 | 18.9 | 20.6 | 22.3 | 24 | 25.7 | 27.4 | 29.1 | 30.7 | 32.4 | 34 | 82 |
| 83 | <5 | <5 | <5 | <5 | <5 | <5 | <5 | <5 | <5 | <5 | 6.3 | 8.2 | 9.9 | 11.6 | 13.1 | 14.9 | 16.6 | 18.4 | 20.1 | 21.8 | 23.5 | 25.2 | 26.9 | 28.6 | 30.3 | 32 | 33.7 | 83 |
| 84 | <5 | <5 | <5 | <5 | <5 | <5 | <5 | <5 | <5 | <5 | 5.5 | 7.4 | 9.2 | 10.9 | 12.5 | 14.3 | 16.1 | 17.8 | 19.6 | 21.3 | 23 | 24.8 | 26.5 | 28.2 | 29.9 | 31.6 | 33.3 | 84 |
| 85 | <5 | <5 | <5 | <5 | <5 | <5 | <5 | <5 | <5 | <5 | <5 | 6.6 | 8.5 | 10.3 | 11.9 | 13.7 | 15.5 | 17.3 | 19 | 20.8 | 22.6 | 24.3 | 26 | 27.8 | 29.5 | 31.2 | 32.9 | 85 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |

FIG. 15A

| 3.2.3 Outdoor Condenser Entering Air Dry-Bulb Temperature (°F) | 3.2.2 Indoor Entering Air Wet-Bulb Temperature (°F) | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |
| 86 | <5 | <5 | <5 | <5 | <5 | <5 | <5 | <5 | <5 | <5 | <5 | 5.8 | 7.8 | 9.6 | 11.3 | 13.2 | 15 | 16.7 | 18.5 | 20.3 | 22.1 | 23.8 | 25.6 | 27.3 | 29.1 | 30.8 | 32.6 | 86 |
| 87 | <5 | <5 | <5 | <5 | <5 | <5 | <5 | <5 | <5 | <5 | <5 | 5 | 7 | 8.9 | 10.6 | 12.6 | 14.4 | 16.2 | 18 | 19.8 | 21.6 | 23.4 | 25.1 | 26.9 | 28.7 | 30.4 | 32.2 | 87 |
| 88 | <5 | <5 | <5 | <5 | <5 | <5 | <5 | <5 | <5 | <5 | <5 | <5 | 6.3 | 8.2 | 10 | 12 | 13.9 | 15.7 | 17.5 | 19.3 | 21.1 | 22.9 | 24.7 | 26.5 | 28.3 | 30.1 | 31.8 | 88 |
| 89 | <5 | <5 | <5 | <5 | <5 | <5 | <5 | <5 | <5 | <5 | <5 | <5 | 5.5 | 7.5 | 9.4 | 11.5 | 13.3 | 15.1 | 17 | 18.8 | 20.6 | 22.4 | 24.3 | 26.1 | 27.9 | 29.7 | 31.5 | 89 |
| 90 | <5 | <5 | <5 | <5 | <5 | <5 | <5 | <5 | <5 | <5 | <5 | <5 | <5 | 6.8 | 8.8 | 10.9 | 12.8 | 14.6 | 16.5 | 18.3 | 20.1 | 22 | 23.8 | 25.6 | 27.5 | 29.3 | 31.1 | 90 |
| 91 | <5 | <5 | <5 | <5 | <5 | <5 | <5 | <5 | <5 | <5 | <5 | <5 | <5 | 6.1 | 8.1 | 10.3 | 12.2 | 14.1 | 15.9 | 17.8 | 19.7 | 21.5 | 23.2 | 25.2 | 27.1 | 28.9 | 30.8 | 91 |
| 92 | <5 | <5 | <5 | <5 | <5 | <5 | <5 | <5 | <5 | <5 | <5 | <5 | <5 | 5.4 | 7.5 | 9.8 | 11.7 | 13.5 | 15.4 | 17.3 | 19.2 | 21.1 | 22.9 | 24.8 | 26.7 | 28.5 | 30.4 | 92 |
| 93 | <5 | <5 | <5 | <5 | <5 | <5 | <5 | <5 | <5 | <5 | <5 | <5 | <5 | <5 | 6.8 | 9.2 | 11.1 | 13 | 14.9 | 16.8 | 18.7 | 20.6 | 22.5 | 24.4 | 26.3 | 28.2 | 30.1 | 93 |
| 94 | <5 | <5 | <5 | <5 | <5 | <5 | <5 | <5 | <5 | <5 | <5 | <5 | <5 | <5 | 6.2 | 8.7 | 10.6 | 12.5 | 14.4 | 16.3 | 18.2 | 20.2 | 22.1 | 24 | 25.9 | 27.8 | 29.7 | 94 |
| 95 | <5 | <5 | <5 | <5 | <5 | <5 | <5 | <5 | <5 | <5 | <5 | <5 | <5 | <5 | 5.6 | 8.1 | 10 | 12 | 13.9 | 15.8 | 17.8 | 19.7 | 21.6 | 23.6 | 25.5 | 27.4 | 29.4 | 95 |
| 96 | <5 | <5 | <5 | <5 | <5 | <5 | <5 | <5 | <5 | <5 | <5 | <5 | <5 | <5 | <5 | 7.5 | 9.5 | 11.4 | 13.4 | 15.3 | 17.3 | 19.2 | 21.2 | 23.2 | 25.1 | 27.1 | 29 | 96 |
| 97 | <5 | <5 | <5 | <5 | <5 | <5 | <5 | <5 | <5 | <5 | <5 | <5 | <5 | <5 | <5 | 7 | 8.9 | 10.9 | 12.9 | 14.9 | 16.8 | 18.8 | 20.8 | 22.7 | 24.7 | 26.7 | 28.7 | 97 |
| 98 | <5 | <5 | <5 | <5 | <5 | <5 | <5 | <5 | <5 | <5 | <5 | <5 | <5 | <5 | <5 | 6.4 | 8.4 | 10.4 | 12.4 | 14.4 | 16.4 | 18.3 | 20.3 | 22.3 | 24.3 | 26.3 | 28.3 | 98 |
| 99 | <5 | <5 | <5 | <5 | <5 | <5 | <5 | <5 | <5 | <5 | <5 | <5 | <5 | <5 | <5 | 5.8 | 7.9 | 9.9 | 11.9 | 13.9 | 15.9 | 17.9 | 19.9 | 21.9 | 24 | 26 | 28 | 99 |
| 100 | <5 | <5 | <5 | <5 | <5 | <5 | <5 | <5 | <5 | <5 | <5 | <5 | <5 | <5 | <5 | 5.3 | 7.3 | 9.3 | 11.4 | 13.4 | 15.4 | 17.5 | 19.5 | 21.5 | 23.6 | 25.6 | 27.7 | 100 |
| 101 | <5 | <5 | <5 | <5 | <5 | <5 | <5 | <5 | <5 | <5 | <5 | <5 | <5 | <5 | <5 | <5 | 6.8 | 8.8 | 10.9 | 12.9 | 15 | 17 | 19.1 | 21.1 | 23.2 | 25.3 | 27.3 | 101 |
| 102 | <5 | <5 | <5 | <5 | <5 | <5 | <5 | <5 | <5 | <5 | <5 | <5 | <5 | <5 | <5 | <5 | 6.2 | 8.3 | 10.4 | 12.4 | 14.5 | 16.6 | 18.6 | 20.7 | 22.8 | 24.9 | 27 | 102 |
| 103 | <5 | <5 | <5 | <5 | <5 | <5 | <5 | <5 | <5 | <5 | <5 | <5 | <5 | <5 | <5 | <5 | 5.7 | 7.8 | 9.9 | 11.9 | 14 | 16.1 | 18.2 | 20.3 | 22.4 | 24.5 | 26.7 | 103 |
| 104 | <5 | <5 | <5 | <5 | <5 | <5 | <5 | <5 | <5 | <5 | <5 | <5 | <5 | <5 | <5 | <5 | 5.2 | 7.2 | 9.3 | 11.5 | 13.6 | 15.7 | 17.8 | 19.9 | 22.1 | 24.2 | 26.3 | 104 |
| 105 | <5 | <5 | <5 | <5 | <5 | <5 | <5 | <5 | <5 | <5 | <5 | <5 | <5 | <5 | <5 | <5 | <5 | 6.7 | 8.8 | 11 | 13.1 | 15.2 | 17.4 | 19.5 | 21.7 | 23.8 | 26 | 105 |
| 106 | <5 | <5 | <5 | <5 | <5 | <5 | <5 | <5 | <5 | <5 | <5 | <5 | <5 | <5 | <5 | <5 | <5 | 6.2 | 8.3 | 10.5 | 12.6 | 14.8 | 17 | 19.1 | 21.3 | 23.5 | 25.7 | 106 |
| 107 | <5 | <5 | <5 | <5 | <5 | <5 | <5 | <5 | <5 | <5 | <5 | <5 | <5 | <5 | <5 | <5 | <5 | 5.7 | 7.9 | 10 | 12.2 | 14.4 | 16.6 | 18.7 | 21 | 23.2 | 25.4 | 107 |
| 108 | <5 | <5 | <5 | <5 | <5 | <5 | <5 | <5 | <5 | <5 | <5 | <5 | <5 | <5 | <5 | <5 | <5 | 5.2 | 7.4 | 9.5 | 11.7 | 13.9 | 16.1 | 18.4 | 20.6 | 22.8 | 25.1 | 108 |
| 109 | <5 | <5 | <5 | <5 | <5 | <5 | <5 | <5 | <5 | <5 | <5 | <5 | <5 | <5 | <5 | <5 | <5 | <5 | 6.9 | 9.1 | 11.3 | 13.5 | 15.7 | 18 | 20.2 | 22.5 | 24.7 | 109 |
| 110 | <5 | <5 | <5 | <5 | <5 | <5 | <5 | <5 | <5 | <5 | <5 | <5 | <5 | <5 | <5 | <5 | <5 | <5 | 6.4 | 8.6 | 10.8 | 13.1 | 15.3 | 17.6 | 19.9 | 22.1 | 24.4 | 110 |
| 111 | <5 | <5 | <5 | <5 | <5 | <5 | <5 | <5 | <5 | <5 | <5 | <5 | <5 | <5 | <5 | <5 | <5 | <5 | 5.9 | 8.1 | 10.4 | 12.6 | 14.9 | 17.2 | 19.5 | 21.8 | 24.1 | 111 |
| 112 | <5 | <5 | <5 | <5 | <5 | <5 | <5 | <5 | <5 | <5 | <5 | <5 | <5 | <5 | <5 | <5 | <5 | <5 | 5.4 | 7.6 | 9.9 | 12.2 | 14.5 | 16.8 | 19.1 | 21.5 | 23.8 | 112 |
| 113 | <5 | <5 | <5 | <5 | <5 | <5 | <5 | <5 | <5 | <5 | <5 | <5 | <5 | <5 | <5 | <5 | <5 | <5 | <5 | 7.2 | 9.5 | 11.8 | 14.1 | 16.4 | 18.8 | 21.1 | 23.5 | 113 |
| 114 | <5 | <5 | <5 | <5 | <5 | <5 | <5 | <5 | <5 | <5 | <5 | <5 | <5 | <5 | <5 | <5 | <5 | <5 | <5 | 6.7 | 9 | 11.4 | 13.7 | 16.1 | 18.4 | 20.8 | 23.2 | 114 |
| 115 | <5 | <5 | <5 | <5 | <5 | <5 | <5 | <5 | <5 | <5 | <5 | <5 | <5 | <5 | <5 | <5 | <5 | <5 | <5 | 6.2 | 8.6 | 10.9 | 13.3 | 15.7 | 18.1 | 20.5 | 22.9 | 115 |
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 | |

*FIG. 15B*

| # | PSIG | Degrees °F | Refrigerant | # | PSIG | Degrees °F | Refrigerant |
|---|---|---|---|---|---|---|---|
| 1 | -6.2 | -50 | R-22 | 1 | 0.4 | -60 | R-410a |
| 2 | -6 | -49.7 | R-22 | 2 | 1 | -58.6 | R-410a |
| 3 | -5 | -48.3 | R-22 | 3 | 2 | -56.4 | R-410a |
| 4 | -4.8 | -48 | R-22 | 4 | 2.6 | -55 | R-410a |
| 5 | -4 | -46.9 | R-22 | 5 | 3 | -54.2 | R-410a |
| 6 | -3 | -46 | R-22 | 6 | 4 | -52.2 | R-410a |
| 7 | -2 | -44 | R-22 | 7 | 5 | -50.2 | R-410a |
| 8 | -1 | -42.7 | R-22 | 8 | 5.1 | -50 | R-410a |
| 9 | -0.5 | -42 | R-22 | 9 | 6 | -48.3 | R-410a |
| 10 | 0 | -41 | R-22 | 10 | 7 | -46.5 | R-410a |
| 11 | 0.5 | -40 | R-22 | 11 | 7.8 | -45 | R-410a |
| 12 | 1 | -38.8 | R-22 | 12 | 8 | -44.7 | R-410a |
| 13 | 1.3 | -38 | R-22 | 13 | 9 | -43.1 | R-410a |
| 14 | 2 | -36.4 | R-22 | 14 | 10 | -41.5 | R-410a |
| 15 | 2.2 | -36 | R-22 | 15 | 10.9 | -40 | R-410a |
| 16 | 3 | -34 | R-22 | 16 | 11 | -39.8 | R-410a |
| 17 | 4 | -32 | R-22 | 17 | 12 | -37.7 | R-410a |
| 18 | 4.9 | -30 | R-22 | 18 | 13 | -36.2 | R-410a |
| 19 | 5 | -29.8 | R-22 | 19 | 14 | -34.7 | R-410a |
| 20 | 5.9 | -28 | R-22 | 20 | 15 | -33.4 | R-410a |
| 21 | 6 | -27.8 | R-22 | 21 | 16 | -32 | R-410a |
| 22 | 6.9 | -26 | R-22 | 22 | 17 | -30.7 | R-410a |
| 23 | 7 | -25.8 | R-22 | 23 | 18 | -29.4 | R-410a |
| 24 | 8 | -24 | R-22 | 24 | 19 | -33.2 | R-410a |
| 25 | 9 | -22 | R-22 | 25 | 20 | -36.9 | R-410a |
| 26 | 10 | -20.2 | R-22 | 26 | 21 | -30.7 | R-410a |
| 27 | 10.1 | -20 | R-22 | 27 | 22 | -24.5 | R-410a |
| 28 | 11 | -18.5 | R-22 | 28 | 23 | -23.4 | R-410a |
| 29 | 11.3 | -18 | R-22 | 29 | 24 | -22.2 | R-410a |
| 30 | 12 | -16.8 | R-22 | 30 | 25 | -21.1 | R-410a |
| 31 | 12.5 | -16 | R-22 | 31 | 26 | -20 | R-410a |
| 32 | 13 | -15.2 | R-22 | 32 | 27 | -19 | R-410a |
| 33 | 13.8 | -14 | R-22 | 33 | 28 | -17.9 | R-410a |
| 34 | 14 | -13.7 | R-22 | 34 | 29 | -16.9 | R-410a |
| 35 | 15 | -12.2 | R-22 | 35 | 30 | -15.8 | R-410a |
| 36 | 15.1 | -12 | R-22 | 36 | 31 | -14.8 | R-410a |
| 37 | 16 | -10.7 | R-22 | 37 | 32 | -13.8 | R-410a |
| 38 | 16.5 | -10 | R-22 | 38 | 33 | -12.9 | R-410a |
| 39 | 17 | -9.3 | R-22 | 39 | 34 | -11.9 | R-410a |
| 40 | 17.9 | -8 | R-22 | 40 | 35 | -11 | R-410a |
| 41 | 18 | -7.9 | R-22 | 41 | 36 | -10.1 | R-410a |
| 42 | 19 | -6.4 | R-22 | 42 | 37 | -9.2 | R-410a |
| 43 | 19.3 | -6 | R-22 | 43 | 38 | -8.3 | R-410a |

*FIG. 16A*

| # | PSIG | Degrees °F | Refrigerant | # | PSIG | Degrees °F | Refrigerant |
|---|---|---|---|---|---|---|---|
| 44 | 20 | -5.1 | R-22 | 44 | 39 | -7.4 | R-410a |
| 45 | 20.8 | -4 | R-22 | 45 | 40 | -6.5 | R-410a |
| 46 | 21 | -3.8 | R-22 | 46 | 41 | -5.5 | R-410a |
| 47 | 22 | -2.5 | R-22 | 47 | 42 | -4.5 | R-410a |
| 48 | 22.4 | -2 | R-22 | 48 | 43 | -3.9 | R-410a |
| 49 | 23 | -1.3 | R-22 | 49 | 44 | -3.2 | R-410a |
| 50 | 24 | 0 | R-22 | 50 | 45 | -2.4 | R-410a |
| 51 | 25 | 1.3 | R-22 | 51 | 46 | -1.6 | R-410a |
| 52 | 25.6 | 2 | R-22 | 52 | 47 | -0.8 | R-410a |
| 53 | 26 | 2.5 | R-22 | 53 | 48 | 0 | R-410a |
| 54 | 27 | 3.6 | R-22 | 54 | 49 | 0.8 | R-410a |
| 55 | 27.3 | 4 | R-22 | 55 | 50 | 1.5 | R-410a |
| 56 | 28 | 4.8 | R-22 | 56 | 51 | 2.3 | R-410a |
| 57 | 29 | 5.9 | R-22 | 57 | 52 | 3 | R-410a |
| 58 | 29.1 | 6 | R-22 | 58 | 53 | 3.8 | R-410a |
| 59 | 30 | 7 | R-22 | 59 | 54 | 4.5 | R-410a |
| 60 | 30.9 | 8 | R-22 | 60 | 55 | 5.2 | R-410a |
| 61 | 31 | 8.1 | R-22 | 61 | 56 | 5.9 | R-410a |
| 62 | 32 | 9.2 | R-22 | 62 | 57 | 6.6 | R-410a |
| 63 | 32.8 | 10 | R-22 | 63 | 58 | 7.3 | R-410a |
| 64 | 33 | 10.2 | R-22 | 64 | 59 | 8 | R-410a |
| 65 | 34 | 11.3 | R-22 | 65 | 60 | 8.6 | R-410a |
| 66 | 34.7 | 12 | R-22 | 66 | 61 | 9.3 | R-410a |
| 67 | 35 | 12.3 | R-22 | 67 | 62 | 10 | R-410a |
| 68 | 36 | 13.3 | R-22 | 68 | 63 | 10.7 | R-410a |
| 69 | 36.7 | 14 | R-22 | 69 | 64 | 11.3 | R-410a |
| 70 | 37 | 14.3 | R-22 | 70 | 65 | 12 | R-410a |
| 71 | 38 | 15.3 | R-22 | 71 | 66 | 12.6 | R-410a |
| 72 | 38.7 | 16 | R-22 | 72 | 67 | 13.2 | R-410a |
| 73 | 39 | 16.3 | R-22 | 73 | 68 | 13.8 | R-410a |
| 74 | 40.9 | 18 | R-22 | 74 | 69 | 14.5 | R-410a |
| 75 | 41 | 18.1 | R-22 | 75 | 70 | 15.1 | R-410a |
| 76 | 42 | 19 | R-22 | 76 | 71 | 15.7 | R-410a |
| 77 | 43 | 20 | R-22 | 77 | 72 | 16.3 | R-410a |
| 78 | 44 | 20.9 | R-22 | 78 | 73 | 16.9 | R-410a |
| 79 | 45 | 21.7 | R-22 | 79 | 74 | 17.5 | R-410a |
| 80 | 45.3 | 22 | R-22 | 80 | 75 | 18.1 | R-410a |
| 81 | 46 | 22.6 | R-22 | 81 | 76 | 18.7 | R-410a |
| 82 | 47 | 23.5 | R-22 | 82 | 77 | 19.3 | R-410a |
| 83 | 47.6 | 24 | R-22 | 83 | 78 | 19.8 | R-410a |
| 84 | 48 | 24.3 | R-22 | 84 | 79 | 20.4 | R-410a |
| 85 | 49 | 25.2 | R-22 | 85 | 80 | 21 | R-410a |
| 86 | 49.9 | 26 | R-22 | 86 | 81 | 21.6 | R-410a |
| 87 | 50 | 26.1 | R-22 | 87 | 82 | 22.1 | R-410a |
| 88 | 51 | 26.9 | R-22 | 88 | 83 | 22.7 | R-410a |
| 89 | 52 | 27.7 | R-22 | 89 | 84 | 23.2 | R-410a |

*FIG. 16B*

| # | PSIG | Degrees °F | Refrigerant | # | PSIG | Degrees °F | Refrigerant |
|---|---|---|---|---|---|---|---|
| 90 | 52.4 | 28 | R-22 | 90 | 85 | 23.8 | R-410a |
| 91 | 53 | 28.5 | R-22 | 91 | 86 | 24.3 | R-410a |
| 92 | 54 | 29.3 | R-22 | 92 | 87 | 24.9 | R-410a |
| 93 | 54.9 | 30 | R-22 | 93 | 88 | 25.4 | R-410a |
| 94 | 55 | 30.1 | R-22 | 94 | 89 | 25.9 | R-410a |
| 95 | 56 | 30.8 | R-22 | 95 | 90 | 26.4 | R-410a |
| 96 | 57 | 31.6 | R-22 | 96 | 91 | 26.9 | R-410a |
| 97 | 57.5 | 32 | R-22 | 97 | 92 | 27.4 | R-410a |
| 98 | 58 | 32.4 | R-22 | 98 | 93 | 28 | R-410a |
| 99 | 59 | 33.2 | R-22 | 99 | 94 | 28.5 | R-410a |
| 100 | 60 | 33.9 | R-22 | 100 | 95 | 29 | R-410a |
| 101 | 60.1 | 34 | R-22 | 101 | 96 | 29.5 | R-410a |
| 102 | 61 | 34.7 | R-22 | 102 | 97 | 30 | R-410a |
| 103 | 62 | 35.4 | R-22 | 103 | 98 | 30.5 | R-410a |
| 104 | 62.8 | 36 | R-22 | 104 | 99 | 30.9 | R-410a |
| 105 | 63 | 36.1 | R-22 | 105 | 100 | 31.2 | R-410a |
| 106 | 64 | 36.9 | R-22 | 106 | 101 | 31.7 | R-410a |
| 107 | 65 | 37.6 | R-22 | 107 | 102 | 32.2 | R-410a |
| 108 | 65.6 | 38 | R-22 | 108 | 103 | 32.7 | R-410a |
| 109 | 66 | 38.3 | R-22 | 109 | 104 | 33.2 | R-410a |
| 110 | 67 | 39 | R-22 | 110 | 105 | 33.7 | R-410a |
| 111 | 68 | 39.7 | R-22 | 111 | 106 | 34.1 | R-410a |
| 112 | 68.5 | 40 | R-22 | 112 | 107 | 34.6 | R-410a |
| 113 | 69 | 40.3 | R-22 | 113 | 108 | 35.1 | R-410a |
| 114 | 70 | 41 | R-22 | 114 | 109 | 35.3 | R-410a |
| 115 | 71 | 41.7 | R-22 | 115 | 110 | 35.5 | R-410a |
| 116 | 71.5 | 42 | R-22 | 116 | 111 | 36.2 | R-410a |
| 117 | 72 | 42.3 | R-22 | 117 | 112 | 36.9 | R-410a |
| 118 | 73 | 43 | R-22 | 118 | 113 | 37.4 | R-410a |
| 119 | 74 | 43.7 | R-22 | 119 | 114 | 37.8 | R-410a |
| 120 | 74.5 | 44 | R-22 | 120 | 115 | 38.3 | R-410a |
| 121 | 75 | 44.3 | R-22 | 121 | 116 | 38.7 | R-410a |
| 122 | 76 | 45 | R-22 | 122 | 117 | 39.1 | R-410a |
| 123 | 77 | 45.6 | R-22 | 123 | 118 | 39.5 | R-410a |
| 124 | 77.6 | 46 | R-22 | 124 | 119 | 40 | R-410a |
| 125 | 78 | 46.3 | R-22 | 125 | 120 | 40.5 | R-410a |
| 126 | 79 | 46.9 | R-22 | 126 | 121 | 40.9 | R-410a |
| 127 | 80 | 47.5 | R-22 | 127 | 122 | 41.3 | R-410a |
| 128 | 80.7 | 48 | R-22 | 128 | 123 | 41.8 | R-410a |
| 129 | 81 | 48.2 | R-22 | 129 | 124 | 42.2 | R-410a |
| 130 | 82 | 48.8 | R-22 | 130 | 125 | 42.6 | R-410a |
| 131 | 83 | 49.4 | R-22 | 131 | 126 | 43 | R-410a |
| 132 | 84 | 50 | R-22 | 132 | 127 | 43.4 | R-410a |
| 133 | 85 | 50.6 | R-22 | 133 | 128 | 43.8 | R-410a |
| 134 | 86 | 51.2 | R-22 | 134 | 129 | 44.3 | R-410a |
| 135 | 87 | 51.8 | R-22 | 135 | 130 | 44.7 | R-410a |

*FIG. 16C*

| # | PSIG | Degrees °F | Refrigerant | # | PSIG | Degrees °F | Refrigerant |
|---|---|---|---|---|---|---|---|
| 136 | 87.3 | 52 | R-22 | 136 | 131 | 45.1 | R-410a |
| 137 | 88 | 52.4 | R-22 | 137 | 132 | 45.5 | R-410a |
| 138 | 89 | 53 | R-22 | 138 | 133 | 45.9 | R-410a |
| 139 | 90 | 53.5 | R-22 | 139 | 134 | 46.3 | R-410a |
| 140 | 90.8 | 54 | R-22 | 140 | 135 | 46.7 | R-410a |
| 141 | 91 | 54.1 | R-22 | 141 | 136 | 47.1 | R-410a |
| 142 | 92 | 54.7 | R-22 | 142 | 137 | 47.5 | R-410a |
| 143 | 93 | 55.3 | R-22 | 143 | 138 | 47.9 | R-410a |
| 144 | 94 | 55.8 | R-22 | 144 | 140 | 48.7 | R-410a |
| 145 | 94.3 | 56 | R-22 | 145 | 141 | 49.1 | R-410a |
| 146 | 95 | 56.4 | R-22 | 146 | 142 | 49.5 | R-410a |
| 147 | 96 | 56.9 | R-22 | 147 | 143 | 49.9 | R-410a |
| 148 | 97 | 57.5 | R-22 | 148 | 144 | 50.3 | R-410a |
| 149 | 97.9 | 58 | R-22 | 149 | 145 | 50.7 | R-410a |
| 150 | 98 | 58.1 | R-22 | 150 | 146 | 51.1 | R-410a |
| 151 | 99 | 58.6 | R-22 | 151 | 147 | 51.5 | R-410a |
| 152 | 100 | 59.1 | R-22 | 152 | 148 | 51.8 | R-410a |
| 153 | 101 | 59.7 | R-22 | 153 | 149 | 52.2 | R-410a |
| 154 | 101.6 | 60 | R-22 | 154 | 150 | 52.5 | R-410a |
| 155 | 102 | 60.2 | R-22 | 155 | 151 | 52.9 | R-410a |
| 156 | 103 | 60.7 | R-22 | 156 | 152 | 53.3 | R-410a |
| 157 | 104 | 61.3 | R-22 | 157 | 153 | 53.7 | R-410a |
| 158 | 105 | 61.8 | R-22 | 158 | 154 | 54 | R-410a |
| 159 | 105.4 | 62 | R-22 | 159 | 155 | 54.4 | R-410a |
| 160 | 106 | 62.3 | R-22 | 160 | 156 | 54.8 | R-410a |
| 161 | 107 | 62.8 | R-22 | 161 | 157 | 55.2 | R-410a |
| 162 | 108 | 63.3 | R-22 | 162 | 158 | 55.5 | R-410a |
| 163 | 109 | 63.8 | R-22 | 163 | 159 | 55.9 | R-410a |
| 164 | 109.3 | 64 | R-22 | 164 | 160 | 56.2 | R-410a |
| 165 | 110 | 64.4 | R-22 | 165 | 161 | 56.6 | R-410a |
| 166 | 111 | 64.9 | R-22 | 166 | 162 | 57 | R-410a |
| 167 | 112 | 65.4 | R-22 | 167 | 163 | 57.4 | R-410a |
| 168 | 113 | 65.9 | R-22 | 168 | 164 | 57.7 | R-410a |
| 169 | 113.2 | 66 | R-22 | 169 | 165 | 58.1 | R-410a |
| 170 | 114 | 66.4 | R-22 | 170 | 166 | 58.4 | R-410a |
| 171 | 115 | 66.9 | R-22 | 171 | 167 | 58.7 | R-410a |
| 172 | 116 | 67.4 | R-22 | 172 | 168 | 59 | R-410a |
| 173 | 117 | 67.9 | R-22 | 173 | 169 | 59.4 | R-410a |
| 174 | 117.3 | 68 | R-22 | 174 | 170 | 59.8 | R-410a |
| 175 | 118 | 68.3 | R-22 | 175 | 171 | 60.2 | R-410a |
| 176 | 119 | 68.8 | R-22 | 176 | 172 | 60.5 | R-410a |
| 177 | 120 | 69.3 | R-22 | 177 | 173 | 60.8 | R-410a |
| 178 | 121 | 69.8 | R-22 | 178 | 174 | 61.1 | R-410a |
| 179 | 121.4 | 70 | R-22 | 179 | 175 | 61.5 | R-410a |
| 180 | 122 | 70.3 | R-22 | 180 | 176 | 61.8 | R-410a |
| 181 | 123 | 70.7 | R-22 | 181 | 177 | 62.2 | R-410a |

*FIG. 16D*

| # | PSIG | Degrees °F | Refrigerant | # | PSIG | Degrees °F | Refrigerant |
|---|---|---|---|---|---|---|---|
| 182 | 124 | 71.2 | R-22 | 182 | 178 | 62.5 | R-410a |
| 183 | 125 | 71.7 | R-22 | 183 | 179 | 62.8 | R-410a |
| 184 | 125.7 | 72 | R-22 | 184 | 180 | 63.1 | R-410a |
| 185 | 126 | 72.1 | R-22 | 185 | 181 | 63.5 | R-410a |
| 186 | 127 | 72.6 | R-22 | 186 | 182 | 63.8 | R-410a |
| 187 | 128 | 73.1 | R-22 | 187 | 183 | 64.2 | R-410a |
| 188 | 129 | 73.5 | R-22 | 188 | 184 | 64.5 | R-410a |
| 189 | 130 | 74 | R-22 | 189 | 185 | 64.8 | R-410a |
| 190 | 131 | 74.4 | R-22 | 190 | 186 | 65.1 | R-410a |
| 191 | 132 | 74.9 | R-22 | 191 | 187 | 65.5 | R-410a |
| 192 | 133 | 75.3 | R-22 | 192 | 188 | 65.8 | R-410a |
| 193 | 134 | 75.8 | R-22 | 193 | 189 | 66.1 | R-410a |
| 194 | 134.5 | 76 | R-22 | 194 | 190 | 66.4 | R-410a |
| 195 | 135 | 76.2 | R-22 | 195 | 191 | 66.7 | R-410a |
| 196 | 136 | 76.7 | R-22 | 196 | 192 | 67 | R-410a |
| 197 | 137 | 77.1 | R-22 | 197 | 193 | 67.4 | R-410a |
| 198 | 138 | 77.6 | R-22 | 198 | 194 | 67.7 | R-410a |
| 199 | 139 | 78 | R-22 | 199 | 195 | 68 | R-410a |
| 200 | 140 | 78.4 | R-22 | 200 | 196 | 68.3 | R-410a |
| 201 | 141 | 78.9 | R-22 | 201 | 197 | 68.6 | R-410a |
| 202 | 142 | 79.3 | R-22 | 202 | 198 | 68.9 | R-410a |
| 203 | 143 | 79.7 | R-22 | 203 | 199 | 69.2 | R-410a |
| 204 | 143.6 | 80 | R-22 | 204 | 200 | 69.5 | R-410a |
| 205 | 144 | 80.2 | R-22 | 205 | 201 | 69.8 | R-410a |
| 206 | 145 | 80.6 | R-22 | 206 | 202 | 70.1 | R-410a |
| 207 | 146 | 81 | R-22 | 207 | 203 | 70.4 | R-410a |
| 208 | 147 | 81.4 | R-22 | 208 | 204 | 70.7 | R-410a |
| 209 | 148 | 81.8 | R-22 | 209 | 205 | 71.1 | R-410a |
| 210 | 148.4 | 82 | R-22 | 210 | 206 | 71.4 | R-410a |
| 211 | 149 | 82.3 | R-22 | 211 | 207 | 71.7 | R-410a |
| 212 | 150 | 82.7 | R-22 | 212 | 208 | 72 | R-410a |
| 213 | 151 | 83.1 | R-22 | 213 | 209 | 72.3 | R-410a |
| 214 | 152 | 83.5 | R-22 | 214 | 210 | 72.6 | R-410a |
| 215 | 153 | 83.9 | R-22 | 215 | 211 | 72.9 | R-410a |
| 216 | 153.2 | 84 | R-22 | 216 | 212 | 73.2 | R-410a |
| 217 | 154 | 84.3 | R-22 | 217 | 213 | 73.5 | R-410a |
| 218 | 155 | 84.7 | R-22 | 218 | 214 | 73.8 | R-410a |
| 219 | 156 | 85.1 | R-22 | 219 | 215 | 74.1 | R-410a |
| 220 | 157 | 85.5 | R-22 | 220 | 216 | 74.3 | R-410a |
| 221 | 158 | 85.9 | R-22 | 221 | 217 | 74.6 | R-410a |
| 222 | 158.2 | 86 | R-22 | 222 | 218 | 74.9 | R-410a |
| 223 | 159 | 86.3 | R-22 | 223 | 219 | 75.2 | R-410a |
| 224 | 160 | 86.7 | R-22 | 224 | 220 | 75.5 | R-410a |
| 225 | 161 | 87.1 | R-22 | 225 | 221 | 75.8 | R-410a |
| 226 | 162 | 87.5 | R-22 | 226 | 222 | 76.1 | R-410a |
| 227 | 163 | 87.9 | R-22 | 227 | 223 | 76.4 | R-410a |

*FIG. 16E*

| # | PSIG | Degrees °F | Refrigerant | # | PSIG | Degrees °F | Refrigerant |
|---|---|---|---|---|---|---|---|
| 228 | 163.2 | 88 | R-22 | 228 | 224 | 76.7 | R-410a |
| 229 | 164 | 88.3 | R-22 | 229 | 225 | 77 | R-410a |
| 230 | 165 | 88.7 | R-22 | 230 | 226 | 77.2 | R-410a |
| 231 | 166 | 89.1 | R-22 | 231 | 227 | 77.5 | R-410a |
| 232 | 167 | 89.5 | R-22 | 232 | 228 | 77.8 | R-410a |
| 233 | 168 | 89.8 | R-22 | 233 | 229 | 78.1 | R-410a |
| 234 | 168.4 | 90 | R-22 | 234 | 230 | 78.4 | R-410a |
| 235 | 169 | 90.2 | R-22 | 235 | 231 | 78.7 | R-410a |
| 236 | 170 | 90.6 | R-22 | 236 | 232 | 78.9 | R-410a |
| 237 | 171 | 91 | R-22 | 237 | 233 | 79.2 | R-410a |
| 238 | 172 | 91.4 | R-22 | 238 | 234 | 79.5 | R-410a |
| 239 | 173 | 91.7 | R-22 | 239 | 235 | 79.8 | R-410a |
| 240 | 173.7 | 92 | R-22 | 240 | 236 | 80 | R-410a |
| 241 | 174 | 92.1 | R-22 | 241 | 237 | 80.3 | R-410a |
| 242 | 175 | 92.5 | R-22 | 242 | 238 | 80.6 | R-410a |
| 243 | 176 | 92.9 | R-22 | 243 | 239 | 80.9 | R-410a |
| 244 | 177 | 93.2 | R-22 | 244 | 240 | 81.1 | R-410a |
| 245 | 178 | 93.6 | R-22 | 245 | 241 | 81.4 | R-410a |
| 246 | 179 | 94 | R-22 | 246 | 242 | 81.6 | R-410a |
| 247 | 179.1 | 94 | R-22 | 247 | 243 | 81.9 | R-410a |
| 248 | 180 | 94.3 | R-22 | 248 | 244 | 82.2 | R-410a |
| 249 | 181 | 94.7 | R-22 | 249 | 245 | 82.5 | R-410a |
| 250 | 182 | 95.1 | R-22 | 250 | 246 | 82.7 | R-410a |
| 251 | 183 | 95.4 | R-22 | 251 | 247 | 83 | R-410a |
| 252 | 184 | 95.8 | R-22 | 252 | 248 | 83.3 | R-410a |
| 253 | 184.6 | 96 | R-22 | 253 | 249 | 83.6 | R-410a |
| 254 | 185 | 96.1 | R-22 | 254 | 250 | 83.8 | R-410a |
| 255 | 186 | 96.5 | R-22 | 255 | 251 | 84.1 | R-410a |
| 256 | 187 | 96.9 | R-22 | 256 | 252 | 84.3 | R-410a |
| 257 | 188 | 97.2 | R-22 | 257 | 253 | 84.6 | R-410a |
| 258 | 189 | 97.6 | R-22 | 258 | 254 | 84.8 | R-410a |
| 259 | 190 | 97.9 | R-22 | 259 | 255 | 85.1 | R-410a |
| 260 | 190.2 | 98 | R-22 | 260 | 256 | 85.4 | R-410a |
| 261 | 191 | 98.3 | R-22 | 261 | 257 | 85.7 | R-410a |
| 262 | 192 | 98.6 | R-22 | 262 | 258 | 85.9 | R-410a |
| 263 | 193 | 99 | R-22 | 263 | 259 | 86.2 | R-410a |
| 264 | 194 | 99.3 | R-22 | 264 | 260 | 86.4 | R-410a |
| 265 | 195 | 99.7 | R-22 | 265 | 261 | 86.7 | R-410a |
| 266 | 195.9 | 100 | R-22 | 266 | 262 | 86.9 | R-410a |
| 267 | 196 | 100 | R-22 | 267 | 263 | 87.2 | R-410a |
| 268 | 197 | 100.4 | R-22 | 268 | 264 | 87.4 | R-410a |
| 269 | 198 | 100.7 | R-22 | 269 | 265 | 87.7 | R-410a |
| 270 | 199 | 101.1 | R-22 | 270 | 266 | 87.9 | R-410a |
| 271 | 200 | 101.4 | R-22 | 271 | 267 | 88.2 | R-410a |
| 272 | 201 | 101.7 | R-22 | 272 | 268 | 88.4 | R-410a |
| 273 | 201.8 | 102 | R-22 | 273 | 269 | 88.7 | R-410a |

*FIG. 16F*

| # | PSIG | Degrees °F | Refrigerant | # | PSIG | Degrees °F | Refrigerant |
|---|---|---|---|---|---|---|---|
| 274 | 202 | 102.1 | R-22 | 274 | 270 | 88.9 | R-410a |
| 275 | 203 | 102.4 | R-22 | 275 | 271 | 89.2 | R-410a |
| 276 | 204 | 102.7 | R-22 | 276 | 272 | 89.4 | R-410a |
| 277 | 205 | 103.1 | R-22 | 277 | 273 | 89.7 | R-410a |
| 278 | 206 | 103.4 | R-22 | 278 | 274 | 89.9 | R-410a |
| 279 | 207 | 103.8 | R-22 | 279 | 275 | 90.2 | R-410a |
| 280 | 207.7 | 104 | R-22 | 280 | 276 | 90.4 | R-410a |
| 281 | 208 | 104.1 | R-22 | 281 | 277 | 90.7 | R-410a |
| 282 | 209 | 104.4 | R-22 | 282 | 278 | 90.9 | R-410a |
| 283 | 210 | 104.8 | R-22 | 283 | 279 | 91.2 | R-410a |
| 284 | 211 | 105.1 | R-22 | 284 | 280 | 91.4 | R-410a |
| 285 | 212 | 105.4 | R-22 | 285 | 281 | 91.7 | R-410a |
| 286 | 213 | 105.7 | R-22 | 286 | 282 | 91.9 | R-410a |
| 287 | 213.8 | 106 | R-22 | 287 | 283 | 92.2 | R-410a |
| 288 | 214 | 106.1 | R-22 | 288 | 284 | 92.4 | R-410a |
| 289 | 215 | 106.4 | R-22 | 289 | 285 | 92.6 | R-410a |
| 290 | 216 | 106.7 | R-22 | 290 | 286 | 92.8 | R-410a |
| 291 | 217 | 107 | R-22 | 291 | 287 | 93.1 | R-410a |
| 292 | 218 | 107.4 | R-22 | 292 | 288 | 93.3 | R-410a |
| 293 | 219 | 107.7 | R-22 | 293 | 289 | 93.6 | R-410a |
| 294 | 220 | 108 | R-22 | 294 | 290 | 93.8 | R-410a |
| 295 | 221 | 108.3 | R-22 | 295 | 291 | 94.1 | R-410a |
| 296 | 222 | 108.6 | R-22 | 296 | 292 | 94.3 | R-410a |
| 297 | 223 | 108.9 | R-22 | 297 | 293 | 94.6 | R-410a |
| 298 | 224 | 109.3 | R-22 | 298 | 294 | 94.8 | R-410a |
| 299 | 225 | 109.6 | R-22 | 299 | 295 | 95 | R-410a |
| 300 | 226 | 109.9 | R-22 | 300 | 296 | 95.2 | R-410a |
| 301 | 226.4 | 110 | R-22 | 301 | 297 | 95.5 | R-410a |
| 302 | 227 | 110.2 | R-22 | 302 | 298 | 95.7 | R-410a |
| 303 | 228 | 110.5 | R-22 | 303 | 299 | 96 | R-410a |
| 304 | 229 | 110.8 | R-22 | 304 | 300 | 96.2 | R-410a |
| 305 | 230 | 111.1 | R-22 | 305 | 301 | 96.4 | R-410a |
| 306 | 231 | 111.4 | R-22 | 306 | 302 | 96.6 | R-410a |
| 307 | 232 | 111.8 | R-22 | 307 | 303 | 96.9 | R-410a |
| 308 | 232.8 | 112 | R-22 | 308 | 304 | 97.1 | R-410a |
| 309 | 233 | 112.1 | R-22 | 309 | 305 | 97.3 | R-410a |
| 310 | 234 | 112.4 | R-22 | 310 | 306 | 97.5 | R-410a |
| 311 | 235 | 112.7 | R-22 | 311 | 307 | 97.8 | R-410a |
| 312 | 236 | 113 | R-22 | 312 | 308 | 98 | R-410a |
| 313 | 237 | 113.3 | R-22 | 313 | 309 | 98.2 | R-410a |
| 314 | 238 | 113.6 | R-22 | 314 | 310 | 98.4 | R-410a |
| 315 | 239 | 113.9 | R-22 | 315 | 311 | 98.7 | R-410a |
| 316 | 239.4 | 114 | R-22 | 316 | 312 | 98.9 | R-410a |
| 317 | 240 | 114.2 | R-22 | 317 | 313 | 99.1 | R-410a |
| 318 | 241 | 114.5 | R-22 | 318 | 314 | 99.3 | R-410a |
| 319 | 242 | 114.8 | R-22 | 319 | 315 | 99.5 | R-410a |

FIG. 16G

| # | PSIG | Degrees °F | Refrigerant | # | PSIG | Degrees °F | Refrigerant |
|---|---|---|---|---|---|---|---|
| 320 | 243 | 115.1 | R-22 | 320 | 316 | 99.7 | R-410a |
| 321 | 244 | 115.4 | R-22 | 321 | 317 | 100 | R-410a |
| 322 | 245 | 115.7 | R-22 | 322 | 318 | 100.2 | R-410a |
| 323 | 246 | 116 | R-22 | 323 | 319 | 100.5 | R-410a |
| 324 | 246.1 | 116 | R-22 | 324 | 320 | 100.7 | R-410a |
| 325 | 247 | 116.3 | R-22 | 325 | 321 | 100.9 | R-410a |
| 326 | 248 | 116.6 | R-22 | 326 | 322 | 101.1 | R-410a |
| 327 | 249 | 116.9 | R-22 | 327 | 323 | 101.4 | R-410a |
| 328 | 250 | 117.1 | R-22 | 328 | 324 | 101.6 | R-410a |
| 329 | 251 | 117.4 | R-22 | 329 | 325 | 101.8 | R-410a |
| 330 | 252 | 117.7 | R-22 | 330 | 326 | 102 | R-410a |
| 331 | 252.9 | 118 | R-22 | 331 | 327 | 102.2 | R-410a |
| 332 | 253 | 118 | R-22 | 332 | 328 | 102.4 | R-410a |
| 333 | 254 | 118.3 | R-22 | 333 | 329 | 102.7 | R-410a |
| 334 | 255 | 118.6 | R-22 | 334 | 330 | 102.9 | R-410a |
| 335 | 256 | 118.9 | R-22 | 335 | 331 | 103.1 | R-410a |
| 336 | 257 | 119.2 | R-22 | 336 | 332 | 103.3 | R-410a |
| 337 | 258 | 119.5 | R-22 | 337 | 333 | 103.5 | R-410a |
| 338 | 259 | 119.7 | R-22 | 338 | 334 | 103.7 | R-410a |
| 339 | 259.9 | 120 | R-22 | 339 | 335 | 104 | R-410a |
| 340 | 260 | 120 | R-22 | 340 | 336 | 104.2 | R-410a |
| 341 | 261 | 120.3 | R-22 | 341 | 337 | 104.4 | R-410a |
| 342 | 262 | 120.6 | R-22 | 342 | 338 | 104.6 | R-410a |
| 343 | 263 | 120.9 | R-22 | 343 | 339 | 104.9 | R-410a |
| 344 | 264 | 121.2 | R-22 | 344 | 340 | 105.1 | R-410a |
| 345 | 265 | 121.4 | R-22 | 345 | 341 | 105.3 | R-410a |
| 346 | 266 | 121.7 | R-22 | 346 | 342 | 105.4 | R-410a |
| 347 | 267 | 122 | R-22 | 347 | 343 | 104.6 | R-410a |
| 348 | 268 | 122.3 | R-22 | 348 | 344 | 103.7 | R-410a |
| 349 | 269 | 122.5 | R-22 | 349 | 340 | 104 | R-410a |
| 350 | 270 | 122.8 | R-22 | 350 | 336 | 104.2 | R-410a |
| 351 | 271 | 123.1 | R-22 | 351 | 337 | 104.4 | R-410a |
| 352 | 272 | 123.4 | R-22 | 352 | 338 | 104.6 | R-410a |
| 353 | 273 | 123.6 | R-22 | 353 | 339 | 104.9 | R-410a |
| 354 | 274 | 123.9 | R-22 | 354 | 340 | 105.1 | R-410a |
| 355 | 274.3 | 124 | R-22 | 355 | 341 | 105.3 | R-410a |
| 356 | 275 | 124.2 | R-22 | 356 | 342 | 105.4 | R-410a |
| 357 | 276 | 124.5 | R-22 | 357 | 343 | 105.6 | R-410a |
| 358 | 277 | 124.7 | R-22 | 358 | 344 | 105.8 | R-410a |
| 359 | 278 | 125 | R-22 | 359 | 345 | 106.1 | R-410a |
| 360 | 279 | 125.3 | R-22 | 360 | 346 | 106.3 | R-410a |
| 361 | 280 | 125.6 | R-22 | 361 | 347 | 106.5 | R-410a |
| 362 | 281 | 125.8 | R-22 | 362 | 348 | 106.6 | R-410a |
| 363 | 281.6 | 126 | R-22 | 363 | 349 | 106.9 | R-410a |
| 364 | 282 | 126.1 | R-22 | 364 | 350 | 107.1 | R-410a |
| 365 | 283 | 126.4 | R-22 | 365 | 351 | 107.3 | R-410a |

*FIG. 16H*

| # | PSIG | Degrees °F | Refrigerant | # | PSIG | Degrees °F | Refrigerant |
|---|---|---|---|---|---|---|---|
| 366 | 284 | 126.6 | R-22 | 366 | 352 | 107.5 | R-410a |
| 367 | 285 | 126.9 | R-22 | 367 | 353 | 107.7 | R-410a |
| 368 | 286 | 127.2 | R-22 | 368 | 354 | 107.9 | R-410a |
| 369 | 287 | 127.4 | R-22 | 369 | 355 | 108.1 | R-410a |
| 370 | 288 | 127.7 | R-22 | 370 | 356 | 108.3 | R-410a |
| 371 | 289 | 128 | R-22 | 371 | 357 | 108.6 | R-410a |
| 372 | 289.1 | 128 | R-22 | 372 | 358 | 108.8 | R-410a |
| 373 | 290 | 128.2 | R-22 | 373 | 359 | 109 | R-410a |
| 374 | 291 | 128.5 | R-22 | 374 | 360 | 109.2 | R-410a |
| 375 | 292 | 128.8 | R-22 | 375 | 362 | 109.6 | R-410a |
| 376 | 293 | 129 | R-22 | 376 | 364 | 110 | R-410a |
| 377 | 294 | 129.3 | R-22 | 377 | 365 | 110.2 | R-410a |
| 378 | 295 | 129.5 | R-22 | 378 | 366 | 110.4 | R-410a |
| 379 | 296 | 129.8 | R-22 | 379 | 367 | 110.6 | R-410a |
| 380 | 296.8 | 130 | R-22 | 380 | 368 | 110.8 | R-410a |
| 381 | 297 | 130.1 | R-22 | 381 | 369 | 111 | R-410a |
| 382 | 298 | 130.3 | R-22 | 382 | 370 | 111.2 | R-410a |
| 383 | 299 | 130.6 | R-22 | 383 | 371 | 111.4 | R-410a |
| 384 | 300 | 130.8 | R-22 | 384 | 372 | 111.6 | R-410a |
| 385 | 301 | 131.1 | R-22 | 385 | 373 | 111.8 | R-410a |
| 386 | 302 | 131.3 | R-22 | 386 | 374 | 112 | R-410a |
| 387 | 303 | 131.6 | R-22 | 387 | 375 | 112.2 | R-410a |
| 388 | 304 | 131.8 | R-22 | 388 | 376 | 112.4 | R-410a |
| 389 | 304.6 | 132 | R-22 | 389 | 377 | 112.5 | R-410a |
| 390 | 305 | 132.1 | R-22 | 390 | 378 | 112.6 | R-410a |
| 391 | 306 | 132.4 | R-22 | 391 | 379 | 112.9 | R-410a |
| 392 | 307 | 132.6 | R-22 | 392 | 380 | 113.1 | R-410a |
| 393 | 308 | 132.9 | R-22 | 393 | 381 | 113.3 | R-410a |
| 394 | 309 | 133.1 | R-22 | 394 | 382 | 113.5 | R-410a |
| 395 | 310 | 133.4 | R-22 | 395 | 383 | 113.7 | R-410a |
| 396 | 311 | 133.6 | R-22 | 396 | 384 | 113.9 | R-410a |
| 397 | 312 | 133.9 | R-22 | 397 | 385 | 114.1 | R-410a |
| 398 | 312.5 | 134 | R-22 | 398 | 386 | 114.3 | R-410a |
| 399 | 313 | 134.1 | R-22 | 399 | 387 | 114.5 | R-410a |
| 400 | 314 | 134.4 | R-22 | 400 | 388 | 114.7 | R-410a |
| 401 | 315 | 134.6 | R-22 | 401 | 389 | 114.9 | R-410a |
| 402 | 316 | 134.9 | R-22 | 402 | 390 | 115 | R-410a |
| 403 | 317 | 135.1 | R-22 | 403 | 391 | 115.3 | R-410a |
| 404 | 318 | 135.4 | R-22 | 404 | 392 | 115.5 | R-410a |
| 405 | 319 | 135.6 | R-22 | 405 | 393 | 115.7 | R-410a |
| 406 | 320 | 135.9 | R-22 | 406 | 394 | 115.8 | R-410a |
| 407 | 320.6 | 136 | R-22 | 407 | 395 | 116 | R-410a |
| 408 | 321 | 136.1 | R-22 | 408 | 396 | 116.2 | R-410a |
| 409 | 322 | 136.3 | R-22 | 409 | 397 | 116.4 | R-410a |
| 410 | 323 | 136.6 | R-22 | 410 | 398 | 116.6 | R-410a |
| 411 | 324 | 136.8 | R-22 | 411 | 399 | 116.8 | R-410a |

*FIG. 16I*

| # | PSIG | Degrees °F | Refrigerant | # | PSIG | Degrees °F | Refrigerant |
|---|---|---|---|---|---|---|---|
| 412 | 325 | 137.1 | R-22 | 412 | 400 | 117 | R-410a |
| 413 | 326 | 137.3 | R-22 | 413 | 401 | 117.2 | R-410a |
| 414 | 327 | 137.5 | R-22 | 414 | 402 | 117.3 | R-410a |
| 415 | 328 | 137.8 | R-22 | 415 | 403 | 117.5 | R-410a |
| 416 | 328.9 | 138 | R-22 | 416 | 404 | 117.7 | R-410a |
| 417 | 329 | 138 | R-22 | 417 | 405 | 117.9 | R-410a |
| 418 | 330 | 138.3 | R-22 | 418 | 406 | 118.1 | R-410a |
| 419 | 331 | 138.5 | R-22 | 419 | 407 | 118.3 | R-410a |
| 420 | 332 | 138.7 | R-22 | 420 | 408 | 118.5 | R-410a |
| 421 | 333 | 139 | R-22 | 421 | 409 | 118.7 | R-410a |
| 422 | 334 | 139.2 | R-22 | 422 | 410 | 118.8 | R-410a |
| 423 | 335 | 139.5 | R-22 | 423 | 411 | 119 | R-410a |
| 424 | 336 | 139.7 | R-22 | 424 | 412 | 119.2 | R-410a |
| 425 | 337 | 139.9 | R-22 | 425 | 413 | 119.4 | R-410a |
| 426 | 337.3 | 140 | R-22 | 426 | 414 | 119.6 | R-410a |
| 427 | 338 | 140.2 | R-22 | 427 | 415 | 119.8 | R-410a |
| 428 | 339 | 140.4 | R-22 | 428 | 416 | 119.9 | R-410a |
| 429 | 340 | 140.6 | R-22 | 429 | 417 | 120.1 | R-410a |
| 430 | 341 | 140.9 | R-22 | 430 | 418 | 120.3 | R-410a |
| 431 | 342 | 141.1 | R-22 | 431 | 419 | 120.5 | R-410a |
| 432 | 343 | 141.3 | R-22 | 432 | 420 | 120.7 | R-410a |
| 433 | 344 | 141.6 | R-22 | 433 | 421 | 120.9 | R-410a |
| 434 | 345 | 141.8 | R-22 | 434 | 422 | 121 | R-410a |
| 435 | 345.8 | 142 | R-22 | 435 | 423 | 121.2 | R-410a |
| 436 | 346 | 142 | R-22 | 436 | 424 | 121.4 | R-410a |
| 437 | 347 | 142.3 | R-22 | 437 | 425 | 121.6 | R-410a |
| 438 | 348 | 142.5 | R-22 | 438 | 426 | 121.7 | R-410a |
| 439 | 349 | 142.7 | R-22 | 439 | 427 | 121.9 | R-410a |
| 440 | 350 | 143 | R-22 | 440 | 428 | 122.1 | R-410a |
| 441 | 351 | 143.2 | R-22 | 441 | 429 | 122.3 | R-410a |
| 442 | 352 | 143.4 | R-22 | 442 | 430 | 122.5 | R-410a |
| 443 | 353 | 143.6 | R-22 | 443 | 431 | 122.7 | R-410a |
| 444 | 354 | 143.9 | R-22 | 444 | 432 | 122.8 | R-410a |
| 445 | 354.6 | 144 | R-22 | 445 | 433 | 123 | R-410a |
| 446 | 355 | 144.1 | R-22 | 446 | 434 | 123.2 | R-410a |
| 447 | 356 | 144.3 | R-22 | 447 | 435 | 123.4 | R-410a |
| 448 | 357 | 144.6 | R-22 | 448 | 436 | 123.5 | R-410a |
| 449 | 358 | 144.8 | R-22 | 449 | 437 | 123.7 | R-410a |
| 450 | 359 | 145 | R-22 | 450 | 438 | 123.9 | R-410a |
| 451 | 360 | 145.2 | R-22 | 451 | 439 | 124.1 | R-410a |
| 452 | 361 | 145.5 | R-22 | 452 | 440 | 124.2 | R-410a |
| 453 | 362 | 145.7 | R-22 | 453 | 441 | 124.4 | R-410a |
| 454 | 363 | 145.9 | R-22 | 454 | 442 | 124.6 | R-410a |
| 455 | 363.3 | 146 | R-22 | 455 | 443 | 125 | R-410a |
| 456 | 364 | 146.2 | R-22 | 456 | 444 | 125.3 | R-410a |
| 457 | 365 | 146.4 | R-22 | 457 | 446 | 125.5 | R-410a |

*FIG. 16J*

| # | PSIG | Degrees °F | Refrigerant | # | PSIG | Degrees °F | Refrigerant |
|---|---|---|---|---|---|---|---|
| 458 | 366 | 146.6 | R-22 | 458 | 448 | 125.6 | R-410a |
| 459 | 367 | 146.8 | R-22 | 459 | 449 | 125.8 | R-410a |
| 460 | 368 | 147 | R-22 | 460 | 450 | 126 | R-410a |
| 461 | 369 | 147.3 | R-22 | 461 | 451 | 126.2 | R-410a |
| 462 | 370 | 147.5 | R-22 | 462 | 452 | 126.3 | R-410a |
| 463 | 371 | 147.7 | R-22 | 463 | 453 | 126.5 | R-410a |
| 464 | 372 | 147.9 | R-22 | 464 | 454 | 126.6 | R-410a |
| 465 | 372.3 | 148 | R-22 | 465 | 455 | 126.8 | R-410a |
| 466 | 373 | 148.2 | R-22 | 466 | 456 | 127 | R-410a |
| 467 | 374 | 148.4 | R-22 | 467 | 457 | 127.2 | R-410a |
| 468 | 375 | 148.6 | R-22 | 468 | 458 | 127.3 | R-410a |
| 469 | 376 | 148.8 | R-22 | 469 | 459 | 127.5 | R-410a |
| 470 | 377 | 149 | R-22 | 470 | 460 | 127.7 | R-410a |
| 471 | 378 | 149.2 | R-22 | 471 | 461 | 127.9 | R-410a |
| 472 | 379 | 149.5 | R-22 | 472 | 462 | 128 | R-410a |
| 473 | 380 | 149.7 | R-22 | 473 | 463 | 128.2 | R-410a |
| 474 | 381 | 149.9 | R-22 | 474 | 464 | 128.3 | R-410a |
| 475 | 381.5 | 150 | R-22 | 475 | 465 | 128.5 | R-410a |
| | | | | 476 | 466 | 128.7 | R-410a |
| | | | | 477 | 467 | 128.9 | R-410a |
| | | | | 478 | 468 | 129 | R-410a |
| | | | | 479 | 469 | 129.2 | R-410a |
| | | | | 480 | 470 | 129.3 | R-410a |
| | | | | 481 | 471 | 129.5 | R-410a |
| | | | | 482 | 472 | 129.7 | R-410a |
| | | | | 483 | 473 | 129.9 | R-410a |
| | | | | 484 | 474 | 130 | R-410a |
| | | | | 485 | 475 | 130.2 | R-410a |
| | | | | 486 | 476 | 130.3 | R-410a |
| | | | | 487 | 477 | 130.5 | R-410a |
| | | | | 488 | 478 | 130.7 | R-410a |
| | | | | 489 | 479 | 130.9 | R-410a |
| | | | | 490 | 480 | 131 | R-410a |
| | | | | 491 | 481 | 131.2 | R-410a |
| | | | | 492 | 482 | 131.3 | R-410a |
| | | | | 493 | 483 | 131.5 | R-410a |
| | | | | 494 | 484 | 131.6 | R-410a |
| | | | | 495 | 485 | 131.8 | R-410a |
| | | | | 496 | 486 | 132 | R-410a |
| | | | | 497 | 487 | 132.2 | R-410a |
| | | | | 498 | 488 | 132.3 | R-410a |
| | | | | 499 | 489 | 132.5 | R-410a |
| | | | | 500 | 490 | 132.6 | R-410a |
| | | | | 501 | 491 | 132.8 | R-410a |
| | | | | 502 | 492 | 132.9 | R-410a |
| | | | | 503 | 493 | 133.1 | R-410a |

FIG. 16K

| # | PSIG | Degrees °F | Refrigerant | # | PSIG | Degrees °F | Refrigerant |
|---|---|---|---|---|---|---|---|
| | | | | 504 | 494 | 133.3 | R-410a |
| | | | | 505 | 495 | 133.5 | R-410a |
| | | | | 506 | 496 | 133.6 | R-410a |
| | | | | 507 | 497 | 133.8 | R-410a |
| | | | | 508 | 498 | 133.9 | R-410a |
| | | | | 509 | 499 | 134 | R-410a |
| | | | | 510 | 500 | 134 | R-410a |
| | | | | 511 | 501 | 134.3 | R-410a |
| | | | | 512 | 502 | 134.5 | R-410a |
| | | | | 513 | 503 | 134.7 | R-410a |
| | | | | 514 | 504 | 134.8 | R-410a |
| | | | | 515 | 505 | 135 | R-410a |
| | | | | 516 | 506 | 135.2 | R-410a |
| | | | | 517 | 507 | 135.4 | R-410a |
| | | | | 518 | 508 | 135.5 | R-410a |
| | | | | 519 | 509 | 135.7 | R-410a |
| | | | | 520 | 510 | 135.8 | R-410a |
| | | | | 521 | 511 | 136 | R-410a |
| | | | | 522 | 512 | 136.1 | R-410a |
| | | | | 523 | 513 | 136.3 | R-410a |
| | | | | 524 | 514 | 136.4 | R-410a |
| | | | | 525 | 515 | 136.6 | R-410a |
| | | | | 526 | 516 | 136.7 | R-410a |
| | | | | 527 | 517 | 136.9 | R-410a |
| | | | | 528 | 518 | 137 | R-410a |
| | | | | 529 | 519 | 137.2 | R-410a |
| | | | | 530 | 520 | 137.3 | R-410a |
| | | | | 531 | 521 | 137.5 | R-410a |
| | | | | 532 | 522 | 137.6 | R-410a |
| | | | | 533 | 523 | 137.8 | R-410a |
| | | | | 534 | 524 | 137.9 | R-410a |
| | | | | 535 | 525 | 138.1 | R-410a |
| | | | | 536 | 526 | 138.3 | R-410a |
| | | | | 537 | 527 | 138.5 | R-410a |
| | | | | 538 | 528 | 138.6 | R-410a |
| | | | | 539 | 529 | 138.8 | R-410a |
| | | | | 540 | 530 | 138.9 | R-410a |
| | | | | 541 | 531 | 139.1 | R-410a |
| | | | | 542 | 532 | 139.2 | R-410a |
| | | | | 543 | 533 | 139.4 | R-410a |
| | | | | 544 | 534 | 139.5 | R-410a |
| | | | | 545 | 535 | 139.7 | R-410a |
| | | | | 546 | 536 | 139.8 | R-410a |
| | | | | 547 | 537 | 140 | R-410a |
| | | | | 548 | 538 | 140.1 | R-410a |
| | | | | 549 | 539 | 140.3 | R-410a |

*FIG. 16L*

| # | PSIG | Degrees °F | Refrigerant | # | PSIG | Degrees °F | Refrigerant |
|---|---|---|---|---|---|---|---|
| | | | | 550 | 540 | 140.4 | R-410a |
| | | | | 551 | 541 | 140.6 | R-410a |
| | | | | 552 | 540 | 140.4 | R-410a |
| | | | | 553 | 541 | 140.6 | R-410a |
| | | | | 554 | 542 | 140.7 | R-410a |
| | | | | 555 | 543 | 140.9 | R-410a |
| | | | | 556 | 544 | 141 | R-410a |
| | | | | 557 | 545 | 141.2 | R-410a |
| | | | | 558 | 546 | 141.3 | R-410a |
| | | | | 559 | 547 | 141.5 | R-410a |
| | | | | 560 | 548 | 141.6 | R-410a |
| | | | | 561 | 549 | 141.7 | R-410a |
| | | | | 562 | 550 | 141.9 | R-410a |
| | | | | 563 | 551 | 142 | R-410a |
| | | | | 564 | 552 | 142.1 | R-410a |
| | | | | 565 | 553 | 142.3 | R-410a |
| | | | | 566 | 554 | 142.4 | R-410a |
| | | | | 567 | 555 | 142.6 | R-410a |
| | | | | 568 | 556 | 142.7 | R-410a |
| | | | | 569 | 557 | 142.9 | R-410a |
| | | | | 570 | 558 | 143 | R-410a |
| | | | | 571 | 559 | 143.2 | R-410a |
| | | | | 572 | 560 | 143.3 | R-410a |
| | | | | 573 | 561 | 143.5 | R-410a |
| | | | | 574 | 562 | 143.6 | R-410a |
| | | | | 575 | 563 | 143.8 | R-410a |
| | | | | 576 | 564 | 143.9 | R-410a |
| | | | | 577 | 565 | 144.1 | R-410a |
| | | | | 578 | 566 | 144.2 | R-410a |
| | | | | 579 | 567 | 144.4 | R-410a |
| | | | | 580 | 568 | 144.5 | R-410a |
| | | | | 581 | 569 | 144.6 | R-410a |
| | | | | 582 | 570 | 144.8 | R-410a |
| | | | | 583 | 571 | 144.9 | R-410a |
| | | | | 584 | 572 | 145 | R-410a |
| | | | | 585 | 573 | 145.2 | R-410a |
| | | | | 586 | 574 | 145.3 | R-410a |
| | | | | 587 | 575 | 145.5 | R-410a |
| | | | | 588 | 576 | 145.6 | R-410a |
| | | | | 589 | 577 | 145.8 | R-410a |
| | | | | 590 | 578 | 145.9 | R-410a |
| | | | | 591 | 579 | 146.1 | R-410a |
| | | | | 592 | 580 | 146.2 | R-410a |
| | | | | 593 | 581 | 146.3 | R-410a |
| | | | | 594 | 582 | 146.5 | R-410a |
| | | | | 595 | 583 | 146.6 | R-410a |

*FIG. 16M*

| # | PSIG | Degrees °F | Refrigerant | # | PSIG | Degrees °F | Refrigerant |
|---|---|---|---|---|---|---|---|
| | | | | 596 | 584 | 146.7 | R-410a |
| | | | | 597 | 585 | 146.9 | R-410a |
| | | | | 598 | 586 | 147 | R-410a |
| | | | | 599 | 587 | 147.2 | R-410a |
| | | | | 600 | 588 | 147.3 | R-410a |
| | | | | 601 | 589 | 147.5 | R-410a |
| | | | | 602 | 590 | 147.6 | R-410a |
| | | | | 603 | 591 | 147.8 | R-410a |
| | | | | 604 | 592 | 147.9 | R-410a |
| | | | | 605 | 593 | 148 | R-410a |
| | | | | 606 | 594 | 148.2 | R-410a |
| | | | | 607 | 595 | 148.3 | R-410a |
| | | | | 608 | 596 | 148.4 | R-410a |
| | | | | 609 | 597 | 148.6 | R-410a |
| | | | | 610 | 598 | 148.7 | R-410a |
| | | | | 611 | 599 | 148.9 | R-410a |
| | | | | 612 | 600 | 149 | R-410a |
| | | | | 613 | 601 | 149.1 | R-410a |
| | | | | 614 | 602 | 149.3 | R-410a |
| | | | | 615 | 603 | 149.4 | R-410a |
| | | | | 616 | 604 | 149.5 | R-410a |
| | | | | 617 | 605 | 149.7 | R-410a |
| | | | | 618 | 606 | 149.8 | R-410a |
| | | | | 619 | 607 | 150 | R-410a |
| | | | | 620 | 608 | 150.1 | R-410a |
| | | | | 621 | 609 | 150.2 | R-410a |
| | | | | 622 | 610 | 150.4 | R-410a |
| | | | | 623 | 611 | 150.5 | R-410a |
| | | | | 624 | 612 | 150.6 | R-410a |
| | | | | 625 | 613 | 150.8 | R-410a |
| | | | | 626 | 614 | 150.9 | R-410a |
| | | | | 627 | 615 | 151.1 | R-410a |
| | | | | 628 | 616 | 151.2 | R-410a |
| | | | | 629 | 617 | 151.3 | R-410a |
| | | | | 630 | 618 | 151.5 | R-410a |
| | | | | 631 | 619 | 151.6 | R-410a |
| | | | | 632 | 620 | 151.7 | R-410a |
| | | | | 633 | 621 | 151.9 | R-410a |
| | | | | 634 | 622 | 152 | R-410a |
| | | | | 635 | 623 | 152.2 | R-410a |
| | | | | 636 | 624 | 152.3 | R-410a |
| | | | | 637 | 625 | 152.4 | R-410a |
| | | | | 638 | 626 | 152.6 | R-410a |
| | | | | 639 | 627 | 152.7 | R-410a |
| | | | | 640 | 628 | 152.8 | R-410a |
| | | | | 641 | 629 | 153 | R-410a |

*FIG. 16N*

| # | PSIG | Degrees °F | Refrigerant | # | PSIG | Degrees °F | Refrigerant |
|---|---|---|---|---|---|---|---|
| | | | | 642 | 630 | 153.1 | R-410a |
| | | | | 643 | 631 | 153.3 | R-410a |
| | | | | 644 | 632 | 153.4 | R-410a |
| | | | | 645 | 633 | 153.5 | R-410a |
| | | | | 646 | 634 | 153.7 | R-410a |
| | | | | 647 | 635 | 153.8 | R-410a |
| | | | | 648 | 636 | 153.9 | R-410a |
| | | | | 649 | 637 | 154.1 | R-410a |
| | | | | 650 | 638 | 154.2 | R-410a |
| | | | | 651 | 639 | 154.4 | R-410a |
| | | | | 652 | 640 | 154.5 | R-410a |
| | | | | 653 | 641 | 154.6 | R-410a |
| | | | | 654 | 642 | 154.8 | R-410a |
| | | | | 655 | 643 | 154.9 | R-410a |
| | | | | 656 | 644 | 155 | R-410a |
| | | | | 657 | 645 | 155.1 | R-410a |
| | | | | 658 | 646 | 155.3 | R-410a |
| | | | | 659 | 647 | 155.4 | R-410a |
| | | | | 660 | 648 | 155.5 | R-410a |
| | | | | 661 | 649 | 155.7 | R-410a |
| | | | | 662 | 650 | 155.8 | R-410a |
| | | | | 663 | 651 | 156 | R-410a |
| | | | | 664 | 652 | 156.1 | R-410a |
| | | | | 665 | 653 | 156.2 | R-410a |
| | | | | 666 | 654 | 156.4 | R-410a |
| | | | | 667 | 655 | 156.5 | R-410a |
| | | | | 668 | 656 | 156.6 | R-410a |
| | | | | 669 | 657 | 156.7 | R-410a |
| | | | | 670 | 658 | 156.9 | R-410a |
| | | | | 671 | 659 | 157 | R-410a |
| | | | | 672 | 660 | 157.1 | R-410a |
| | | | | 673 | 661 | 157.3 | R-410a |
| | | | | 674 | 662 | 157.4 | R-410a |
| | | | | 675 | 663 | 157.6 | R-410a |
| | | | | 676 | 664 | 157.7 | R-410a |
| | | | | 677 | 665 | 157.8 | R-410a |
| | | | | 678 | 666 | 158 | R-410a |
| | | | | 679 | 667 | 158.1 | R-410a |
| | | | | 680 | 668 | 158.2 | R-410a |
| | | | | 681 | 669 | 158.3 | R-410a |
| | | | | 682 | 670 | 158.5 | R-410a |
| | | | | 683 | 671 | 158.6 | R-410a |
| | | | | 684 | 672 | 158.7 | R-410a |
| | | | | 685 | 673 | 158.8 | R-410a |
| | | | | 686 | 674 | 159 | R-410a |
| | | | | 687 | 675 | 159.1 | R-410a |

*FIG. 16O*

| # | PSIG | Degrees °F | Refrigerant | # | PSIG | Degrees °F | Refrigerant |
|---|---|---|---|---|---|---|---|
| | | | | 688 | 676 | 159.2 | R-410a |
| | | | | 689 | 677 | 159.4 | R-410a |
| | | | | 690 | 678 | 159.5 | R-410a |
| | | | | 691 | 679 | 159.7 | R-410a |
| | | | | 692 | 680 | 159.8 | R-410a |
| | | | | 693 | 681 | 159.9 | R-410a |
| | | | | 694 | 682 | 160.1 | R-410a |
| | | | | 695 | 683 | 160.2 | R-410a |
| | | | | 696 | 684 | 160.3 | R-410a |
| | | | | 697 | 685 | 160.4 | R-410a |
| | | | | 698 | 686 | 160.6 | R-410a |
| | | | | 699 | 687 | 160.7 | R-410a |
| | | | | 700 | 688 | 160.8 | R-410a |
| | | | | 701 | 689 | 160.9 | R-410a |
| | | | | 702 | 690 | 161.1 | R-410a |
| | | | | 703 | 691 | 161.2 | R-410a |
| | | | | 704 | 692 | 161.3 | R-410a |
| | | | | 705 | 693 | 161.4 | R-410a |
| | | | | 706 | 694 | 161.6 | R-410a |
| | | | | 707 | 695 | 161.7 | R-410a |
| | | | | 708 | 696 | 161.8 | R-410a |

*FIG. 16P*

SYSTEM AND METHOD FOR VERIFYING PROPER REFRIGERANT AND AIRFLOW FOR AIR CONDITIONERS AND HEAT PUMPS IN COOLING MODE

RELATED APPLICATIONS

The application claims the benefit of copending U.S. Provisional Patent Application No. 60/611,054 filed Sep. 17, 2004 having the same inventor applicant.

FIELD OF THE INVENTION

The invention generally relates to air-conditioning systems and heat pump systems, especially in cooling mode. The invention more particularly comprises methods and systems for verifying proper refrigerant charge and airflow for split-system and packaged air-conditioning systems and heat pump systems in cooling mode.

BACKGROUND

The present application references U.S. Pat. No. 6,612,455 to inventor Byrne entitled Cap Lock for Assembly and System.

Byrne's cap lock for assembly and system can be used to assist maintenance of proper refrigerant charge and airflow for the life of air conditioners.

Some studies show approximately 50 to 67 percent of air conditioners suffer from improper refrigerant charge and airflow, and this reduces efficiency by approximately 10 to 50 percent ("National Energy Savings Potential from Addressing HVAC Installation Problems," US Environmental Protection Agency, 1998; "Assessment of HVAC Installations in New Air Conditioners in the Southern California Edison Service Territory," Electric Power Research Institute, 1995; "Enhancing the Performance of HVAC and Distribution Systems in Residential New Construction," Hammarlund, J., et al. 1992 ACEEE Summer Study on Energy Efficiency in Buildings. "Field Measurements of Air Conditioners with and without TXVs," Mowris, R., Blankenship, A., Jones, E., 2004 ACEEE Summer Study on Energy Efficiency in Buildings, August 2004).

Potential savings in the United States from proper refrigerant charge and airflow are approximately 19.6 Billion kilowatt-hours per year and electricity demand savings are approximately 10.3 Million kilowatts. Most air conditioning technicians do not have proper training, equipment, or verification methods to ensure proper refrigerant charge and airflow. Instead, technicians rely on rules of thumb such as "add refrigerant until suction line is 6-pack cold or suction pressure is 70 psig or liquid pressure is less than 250 psig." Air conditioners either do not receive regular service or they are serviced periodically and overcharged due to organizational practices of adding refrigerant charge until the suction line is "6-pack cold." This practice causes air conditioners to be overcharged and operate inefficiently.

Some prior art methods involve taking measurements of certain temperatures and pressures of a cooling system and determining if the system either needs refrigerant added or removed. A significant drawback to these methods is that no measure of the amount of refrigerant to be added or removed is known. Instead, the technician must add or remove incremental amounts of refrigerant. With each incremental iteration, the system must be operated and stabilized, typically for fifteen minutes or more, before another set of readings can be taken to determine if the system is now running in an efficient manner. The time involved with this haphazard iterative method results in an unnecessary cost to the consumer. What is called for is a system and method for the diagnosis of air conditioning systems that determines an amount of refrigerant to be added or removed without iteration.

Correcting overcharged systems with improper airflow saves electricity by reducing refrigerant pressure and proportionally reducing electric power usage. It also eliminates problems of liquid refrigerant returning to the compressor causing premature failure. Correcting undercharged air conditioners with improper airflow saves electricity by increasing capacity allowing them to run less which extends the life of the compressor. It also prevents overheating of the compressor and premature failure.

The present invention relates, in part, to a method for verifying proper refrigerant charge and airflow for split-system and packaged air-conditioning systems and heat pump systems in cooling mode to improve performance and efficiency and maintain these attributes over the effective useful life of the air conditioning system.

In particular, the method may be suitable for determining proper R22 and R410a refrigerant level and airflow across the evaporator coil in air-conditioning systems, which are used to cool residential and commercial buildings. The method includes in-operation diagnostic measurements with the compressor and indoor fan switched on. The diagnostic system records site information, air conditioner information, measurement equipment calibration information, measurements used in the algorithms to make predictive recommendations, refrigerant charge and airflow adjustments, and verification data using: 1) personal digital assistant Expert-system Software (PDAES) software; 2) Telephony Expert-system Software (TES), deploying Interactive Voice Response (IVR) technologies; 3) personal computer (PC) software; and 4) internet database software, accessed via a web-based browser interface.

SUMMARY

An apparatus for the diagnosis of a cooling system which receives inputs in the form of data about a cooling system, and measurements made from the cooling system, and which then calculates the amount of refrigerant to be removed or added to the cooling system for optimal performance.

In addition, methods for ensuring correct setup of a cooling system are disclosed. The methods may apply to FXV (fixed expansion valve) systems and may include making and displaying a prediction of a refrigerant adjustment based upon measurements such as return air wetbulb temperature, condenser air entering temperature, refrigerant superheat vapor line temperature, and refrigerant superheat vapor line pressure.

A method for ensuring correct setup of a cooling system is disclosed. The method may apply to TXV (thermostatic expansion valve) systems and may include making and displaying a prediction of a refrigerant adjustment based upon measurements such as refrigerant subcooling liquid line temperature and refrigerant subcooling liquid line pressure.

A method for ensuring correct setup of a cooling system is disclosed. The method may include making and displaying a prediction of a refrigerant adjustment or of an airflow adjustment based upon measurements such as return air wetbulb temperature, return air drybulb temperature and supply air drybulb temperature. Recommendations may also be based upon evaporator coil temperature splits.

BRIEF DESCRIPTION OF THE DRAWINGS

The accompanying drawings, which are incorporated in and constitute a part of the specification, illustrate embodiments of the invention, and, together with the description, serve to explain the principles of the invention:

FIG. 14 is an illustrative example of a temperature split look-up table.

FIGS. 15A-15B are an illustrative example of superheat look-up table.

FIGS. 16A-16P are an illustrative example of a temperature and pressure look-up table for refrigerants R22 and R410a.

DETAILED DESCRIPTION OF THE PREFERRED EMBODIMENTS

Figure 1:
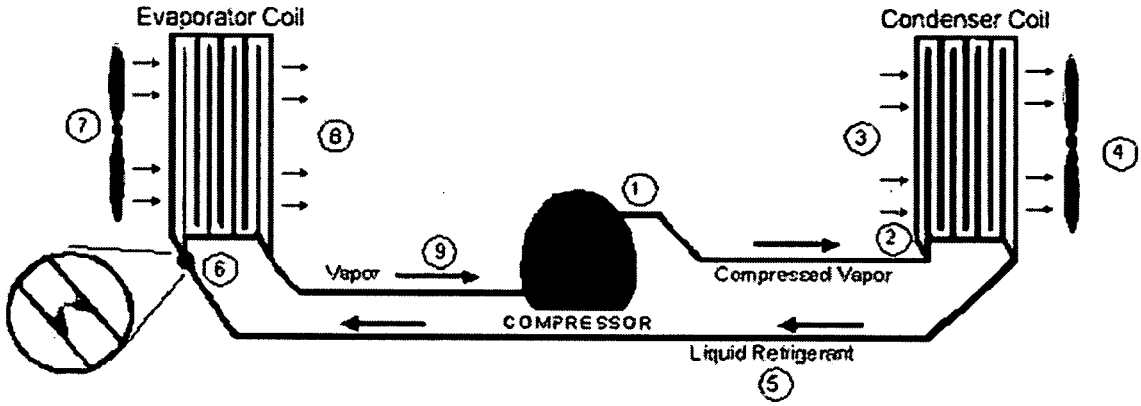
FIG. 1 is a schematic diagram showing an air-conditioning system with provision for refrigerant charge and airflow measurements according to an embodiment of the invention.

In the following description, for purposes of clarity and conciseness of the description, not all of the numerous components shown in the schematics and/or drawings are described. The numerous components are shown in the drawings to provide a person of ordinary skill in the art a thorough, enabling disclosure of the present invention. The operation of many of the components would be understood and apparent to one skilled in the art.

FIG. 1 is a schematic diagram showing an exemplary R22 or R410a air-conditioning system with provision for refrigerant charge and airflow measurements according to an embodiment of the invention. Typically, the compressor 1 compresses refrigerant into high-pressure vapor. Refrigerant vapor thus enters condenser coil 2. Outdoor fan 3 blows air across the exterior of condenser coil 2. This cools refrigerant by removing heat 4 and condenses refrigerant to a liquid. Liquid refrigerant 5 moves along a refrigerant pipeline to inside evaporator coil via an FXV metering device 6 or, in alternative embodiments, via a TXV metering device.

Metering device 6 may control the rate at which refrigerant enters the evaporator coil and may also create a pressure drop. This allows refrigerant to expand from a small diameter tube to a larger one. Fan 7 blows air across inside coil and refrigerant absorbs heat from air 8 and refrigerant evaporates back to vapor. Refrigerant vapor returns to compressor to start cycle over again.

For air conditioners equipped with fixed expansion valve (FXV) devices, factory refrigerant charge and the following measurements may be entered into a subsystem, for example a Personal Digital Assistant Expert-system Software (PDAES) or an automated Telephony Expert-system Software (TES): * Return wetbulb temperature measured at the evaporator coil (near 7, FIG. 1); * Condenser air entering temperature measured at the condenser coil (near 3, FIG. 1); * Vapor temperature and * Vapor pressure, both measured at compressor return (near 9, FIG. 1).

Software algorithms in a PDAES or TES can use these values to diagnose proper refrigerant charge and recommend a weight of refrigerant to add or remove from the air conditioning system so as to achieve a balance of saturated refrigerant vapor in the evaporator coil and condenser coil so as to provide optimal cooling capacity and/or energy efficiency.

For air conditioners equipped with TXV devices, factory refrigerant charge and the following measurements may entered into a subsystem, for example a Personal Digital Assistant Expert-system software (PDAES) or an automated Telephony Expert-system Software (TES): Liquid temperature and pressure are measured at output side of compressor 1 (FIG. 1). Software algorithms such as in a PDAES or automated TES may use these values to diagnose proper refrigerant charge and recommend the weight of refrigerant to add or remove from the air conditioning system to achieve a balance of saturated refrigerant vapor in the evaporator coil and condenser coil, for example to provide optimal cooling capacity and/or energy efficiency.

For either FXV or TXV systems the following measurements are entered into the PDA or automated telephony system: return (entering) wetbulb and drybulb temperatures are measured at (7) at the inside coil (left) and supply drybulb is measured at (8). Software algorithms in the PDAES or automated TES software use these values to diagnose proper airflow across the evaporator coil and recommend corrective steps to improve airflow or to check and correct refrigerant charge to provide optimal cooling capacity and energy efficiency. The airflow methodology is based on standard methods known to persons of ordinary skill in the arts.

Figure 2:
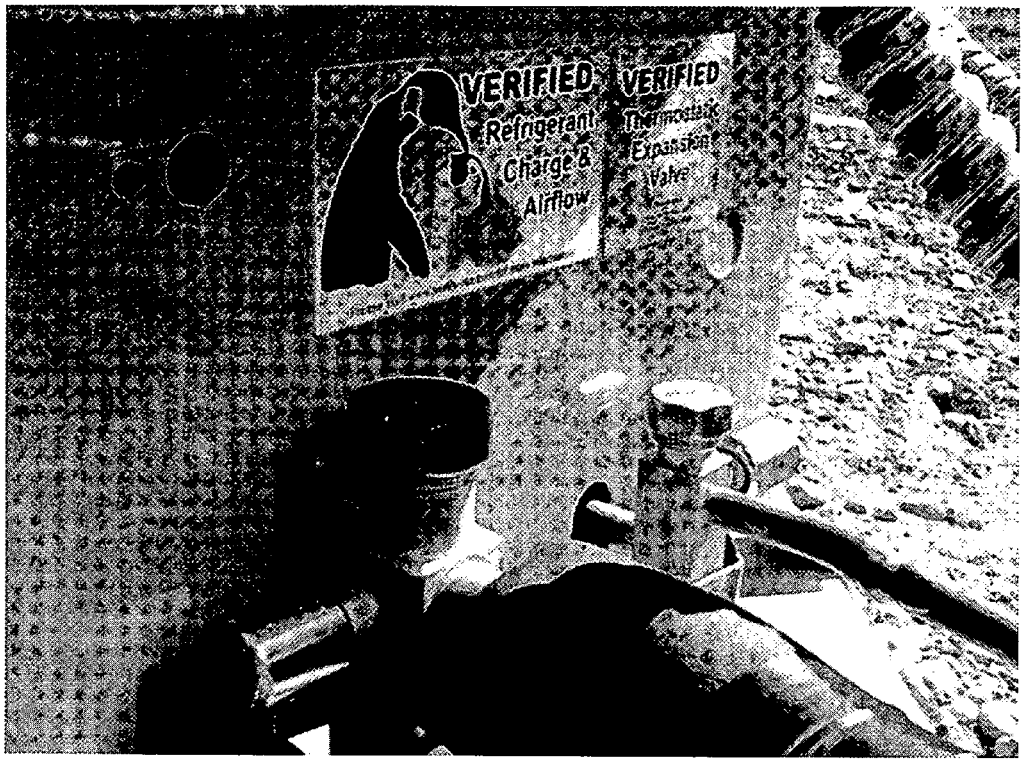
FIG. 2 is a photograph of an air-conditioning system with verified refrigerant charge, airflow and verified thermostatic expansion valve labels and locking, double-sealing, color-coded, and laser-etched Schrader caps to properly identify the air conditioning refrigerant R22 or R410a according to an embodiment of the invention (see U.S. Pat. No. 6,612,455 for reference).

FIG. 2 is a photograph of an air-conditioning system 201 with verified refrigerant charge and airflow label and verified thermostatic expansion valve label maintained with locking, double-sealing, color-coded (green for R22 and red for R410a), laser-etched Schrader caps (see U.S. Pat. No. 6,612,455 for reference).

Figure 3:
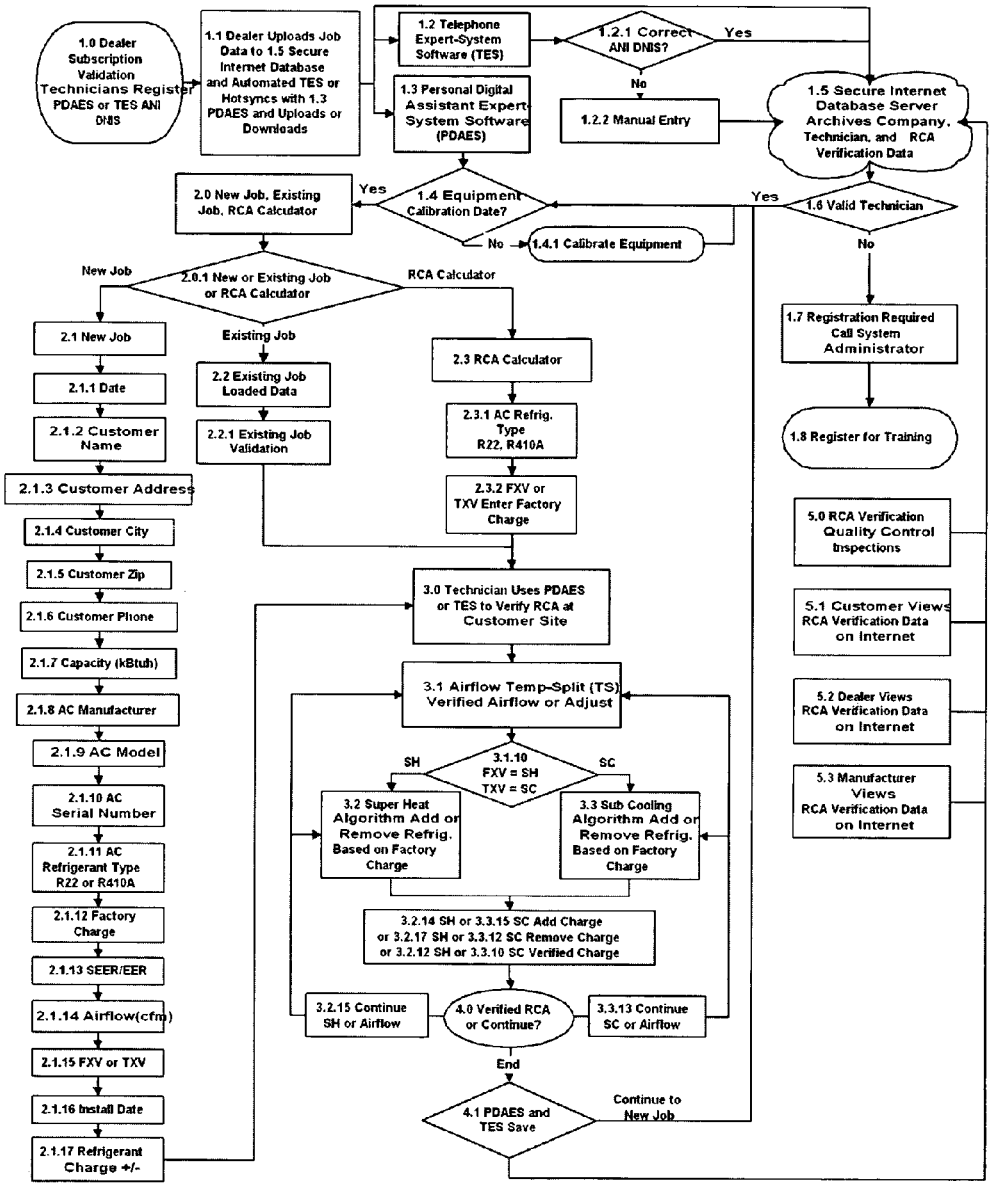
FIG. 3 shows a refrigerant charge and airflow (RCA) verification system process flowchart using PDAES or TES (telephony expert-system software) to diagnose and recommend steps according to an embodiment of the invention.

In some embodiments of the present invention, as seen in FIG. 3, the refrigerant charge and airflow verification process involves interaction between a technician at the site of the air conditioning system and a computer system at a remote location. FIG. 3 shows a refrigerant charge and airflow (RCA) verification system process flowchart showing how jobs may be performed using PDAES or automated TES to diagnose proper RCA and recommend corrective steps to improve airflow and/or to check and correct refrigerant charge and airflow as outlined supra to provide optimal cooling capacity and/or energy efficiency for an operative air-conditioning system such as that of FIG. 1.

Referring again to FIG. 3, in box 1.0, the air conditioner dealer subscribes to use the RCA verification system and provides the following information for each technician: * technician name; * cellular telephone number; and * Environmental Protection Agency refrigerant certification number (as required by Section 608 of the Federal Clean Air Act and Federal Law 40CFR part 82 subpart F). The subscription validation may use this information to register a technician for the Automatic Number Identification (ANI) or Dialed Number Identification Service (DNIS) when using the RCA Verification automated Telephone Expert-system Software (TES) (box 1.2) or Personal Digital Assistant Expert-system Software (PDAES) (box 1.3).

Still referring to FIG. 3, in box 1.1 the dealer uploads air conditioner job data to the Secure Internet Database (box 1.5). Data are uploaded for new jobs (box 2.1) or existing jobs (box 2.2). Job data are specified as indicated in boxes 2.2 through 2.1.17 and as follows: * date (box 2.1.1);

* customer name (box 2.1.2);
* customer address (box 2.1.3);
* customer city (box 2.1.4);
* customer ZIP code (box 2.1.5);
* customer phone number (box 2.1.6);
* air conditioner capacity in thousand British Thermal Units per hour, (kBtuh) (box 2.1.7);
* air conditioner manufacturer (box 2.1.8);
* air conditioner model (box 2.1.9);
* air conditioner serial number (box 2.1.10);
* air conditioner refrigerant type R22 or R410a (box 2.1.11);
* air conditioner factory charge in ounces, (lb. and oz.) (box 2.1.12);
* air conditioner Seasonal Energy Efficiency Ratio (SEER) (box 2.1.13);
* air conditioner airflow, in cubic feet per minute, (cfm) (box 2.1.14);
* air conditioner fixed expansion valve, (FXV), or thermostatic expansion valve, (TXV), (box 2.1.15);
* air conditioner installation date (box 2.1.16); and
* refrigerant charge added or removed (box 2.1.17).

Referring now to FIG. 3 and box 1.2, the TES checks for correct ANI or DNIS automatically (box 1.2.1) and may provide for alternative manual entry (box 1.2.2). If the technician is not validated (box 1.7) then a call may be initiated to the system administrator (box 1.7), and the technician can register for training (box 1.8). The PDAES or TES check the temperature and pressure measurement equipment calibration date (box 1.4). If the equipment has not been calibrated within (typically) 30 days of the current date, then PDAES or TES require calibration (box 1.4.1). With properly calibrated equipment the technician is ready to use the RCA verification system with new or existing job information or use the RCA calculator if the technician is not going to track customer job information (box 2.0). The required information for new or existing jobs is checked (box 2.0.1). The technician may enter information for a new job (boxes 2.1 through 2.1.17) or enter and validate information at the customer site (boxes 2.2 and 2.2.1).

Figure 8A:
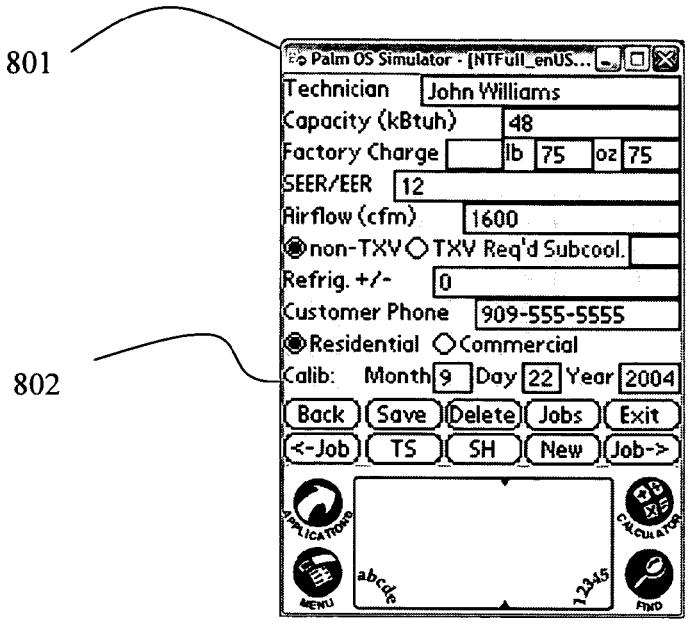
FIGS. 8A-C are PDA displays of the calibration portion according to some embodiments of the present invention.
Figure 8B:
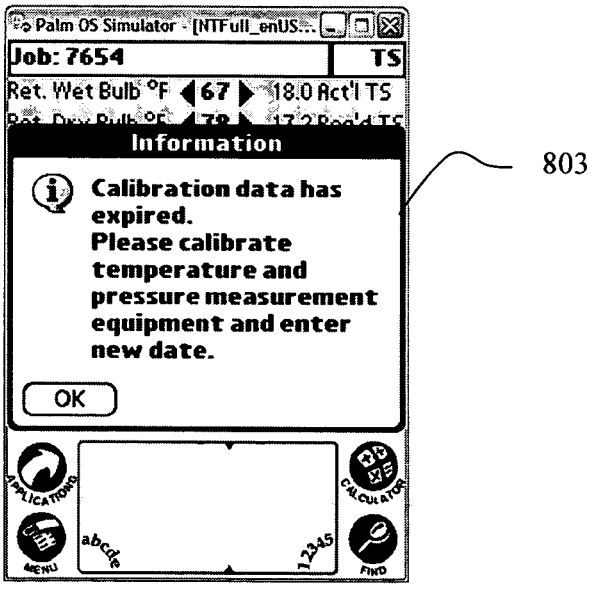
Figure 8C:
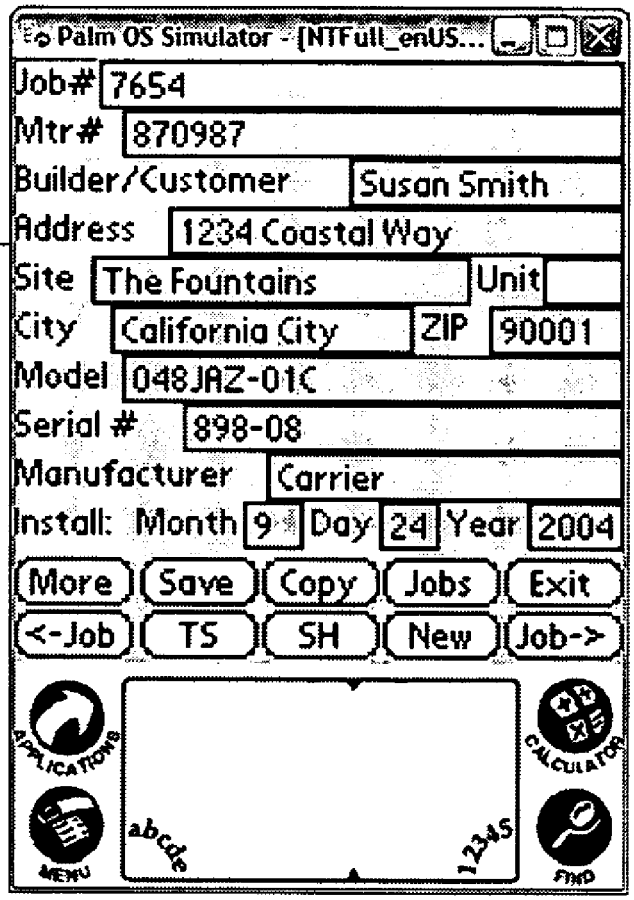

FIG. 8A illustrates a first job display page 801 and a second job display page 804 of a PDA according to some embodiments of the present invention. The information box 803 is displayed when the temperature and pressure measurement equipment calibration date is not valid.

In some embodiments of the present invention, the technician is only using the RCA calculator (box 2.3) and is not planning on linking to a computer system at a remote location. In such a case, the technician may enter air conditioner AC refrigerant type, i.e., R22 or R410a (box 2.3.1), air conditioner expansion device, FXV or TXV, and air conditioner factory charge (box 2.3.2). After entering all required job and air conditioner information, the technician is then ready to use the PDAES or TES to verify RCA at the customer site (box 3.0).

Airflow temperature split measurements are entered next (box 3.1). The airflow procedure is described in detail with reference to FIG. 4 infra. After the airflow temperature split measurements are entered and recommendations are followed, the PDAES or TES may check for FXV or TXV devices (box 3.1.10). The technician enters data to verify proper refrigerant charge using either the SH (superheat) procedure (box 3.2) or SC (subcooling) procedure (box 3.3). These procedures are described in detail in FIGS. 5 and 6 respectively.

The appropriate refrigerant charge verification procedure diagnoses proper refrigerant charge or, alternatively, recommends the weight of refrigerant to add or remove from the air conditioning system to achieve a balance of saturated refrigerant vapor in the evaporator coil and condenser coil to provide optimal cooling capacity and/or energy efficiency (boxes 3.2.14 etc.).

The RCA verification system checks to see if air conditioner RCA are verified (box 4.0). If RCA is not verified, the system recommends further diagnostic measurements of superheat and airflow (box 3.2.15) or further diagnostic measurements of subcooling and airflow (box 3.3.13). The PDAES and TES may save all information entered by technicians regarding measurements and actions taken to verify proper RCA (box 4.1). These data are uploaded to the secure internet database server where data are archived (box 1.5). RCA verification quality control inspections may typically be performed on a statistical random sample of jobs completed by each technician for quality assurance purposes (box 5.0). Customers, dealers, and manufacturers view RCA verification data stored on the secure internet database server using an internet browser by logging on with a user name and password (boxes 5.1, 5.2 and 5.3). FIG. 3 items 3.2.14, 3.3.15, 3.2.17, 3.3.12, 3.2.12 and 3.3.10 are discussed infra in connection with other figures.

Figure 4:
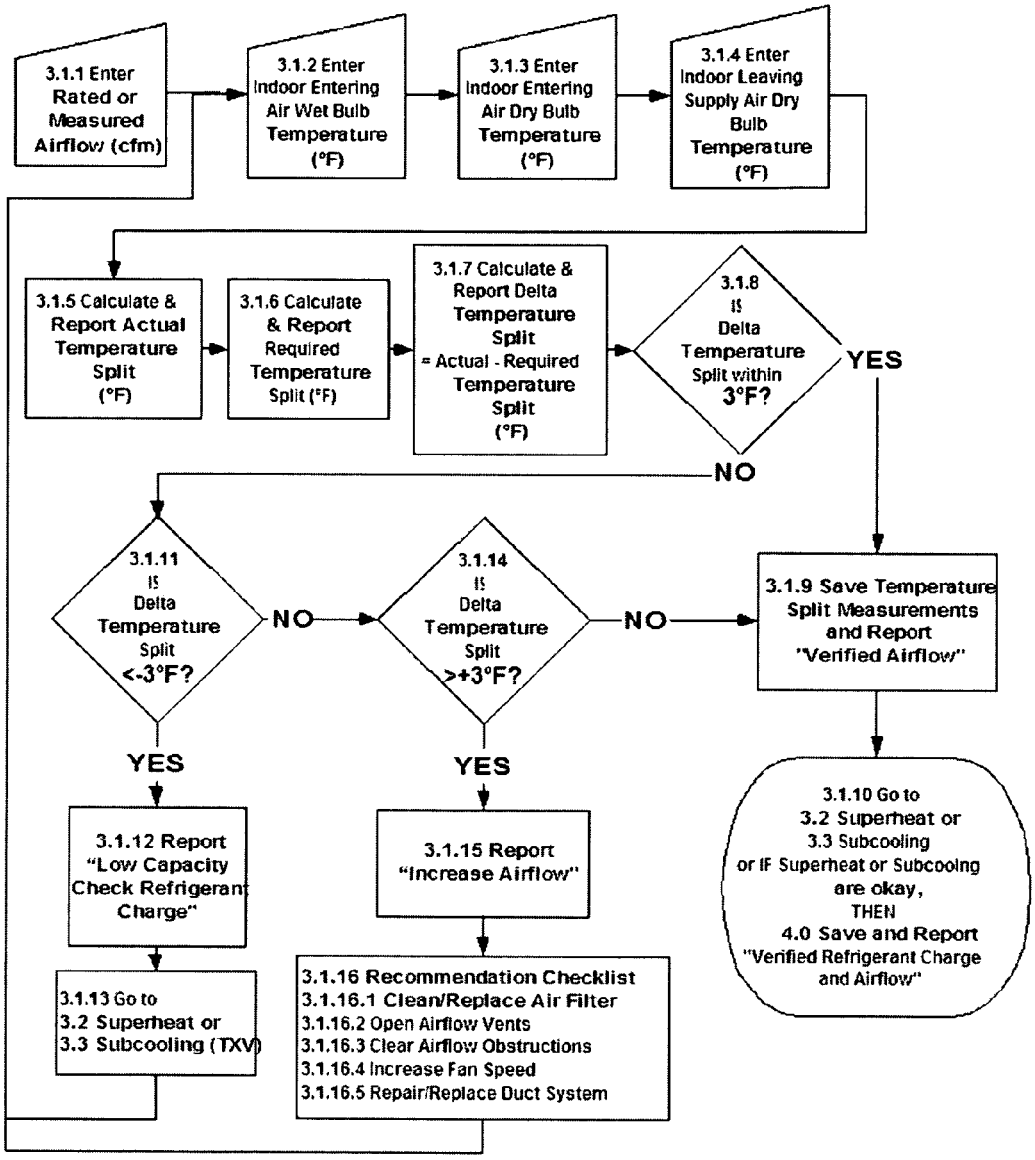
FIG. 4 is an airflow (temperature split method) algorithm flowchart diagram.

FIG. 4 provides an airflow (temperature split method) algorithm flowchart diagram illustrating measurements entered into the PDAES, computer, or TES system—and used by software algorithms to diagnose proper airflow and recommend corrective steps such as to improve airflow to provide optimal cooling capacity and/or energy efficiency for desired operation of an air-conditioning system such as that of FIG. 1. Referring to FIG. 4, in box 3.1.1, a PDAES or TES system may prompt the technician to enter the air conditioner rated or the measured airflow, for example in cfm (cubic feet per minute)

Figure 9A:
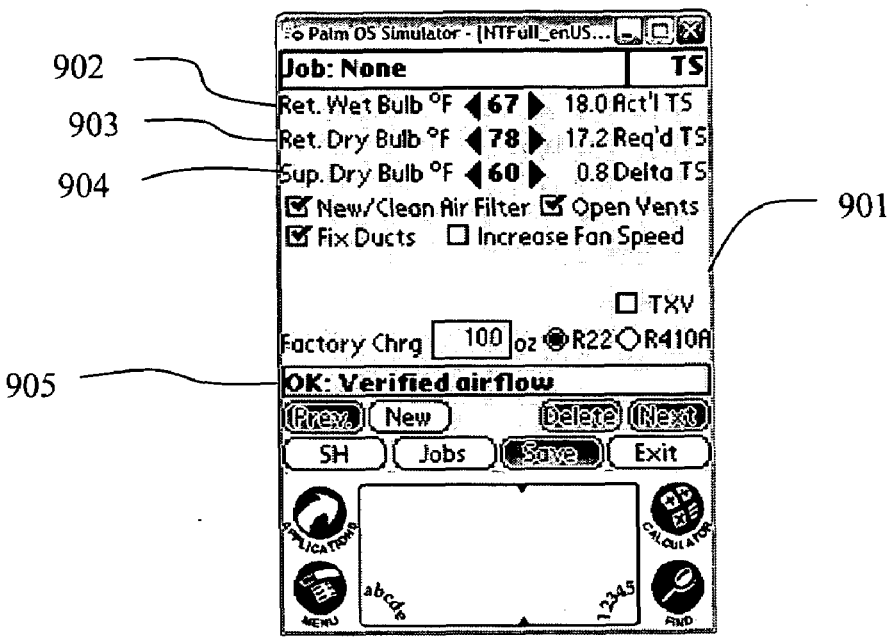
FIGS. 9A-C are PDA displays of the airflow portion according to some embodiments of the present invention.

FIG. 9A illustrates the airflow display 901 of a PDA running software according to some embodiments of the present invention. To begin the airflow temperature split procedure, the technician enters indoor entering air wet bulb temperature, typically in degrees Fahrenheit ° F. (box 3.1.2); indoor entering air dry bulb temperature (box 3.1.3), and indoor leaving supply air dry bulb temperature (box 3.1.4). As seen in FIG. 9A, the indoor entering (return) air wet-bulb temperature 902, the indoor entering (return) dry-bulb temperature 903, and the leaving (supply) air dry-bulb temperature 904 are displayed after having been entered. The PDAES or TES may use these data to calculate and report actual temperature split (box 3.1.5), required temperature split (box 3.1.6), and the delta temperature split. The actual temperature split is calculated by subtracting the leaving supply air dry bulb temperature from the entering air dry bulb temperature. In some embodiments, the computer system (PDA or other device) has stored data including a required temperature split lookup table. An example of such a table is seen in FIG. 14. Based upon the indoor entering air wet bulb temperature, and the indoor entering wet bulb temperature, the stored data provides the required temperature split. Delta temperature split may be calculated as equal to the actual minus required temperature split (box 3.1.7). Also seen on the display 901 are the actual temperature split, the required temperature split, and the delta temperature split. The TES and PDAES may check to see whether the delta temperature split is within a margin such as ±3° F. (box 3.1.8). If the delta temperature split is within ±3° F., then the system may save temperature split measurements and report the "verified airflow" condition (box 3.1.9). The display 901 shows that the air flow is verified 905 in the example illustrated in FIG. 9A.

Figure 9B:
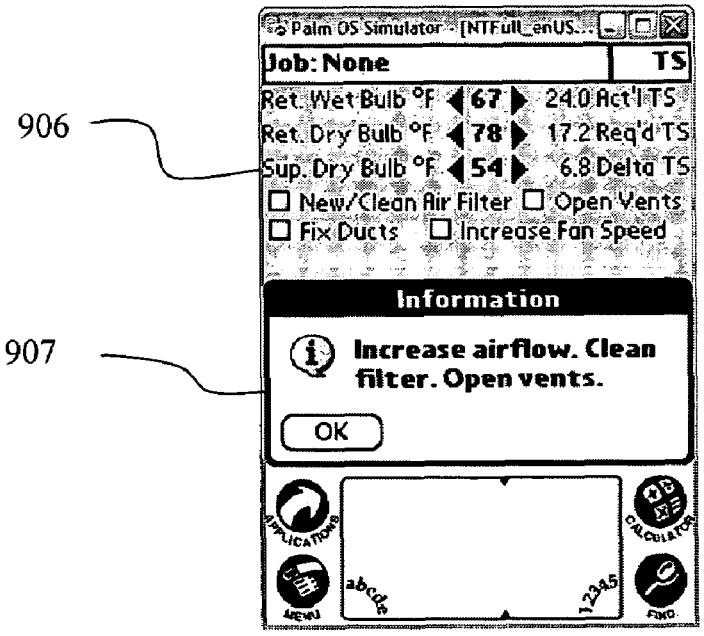
Figure 9C:
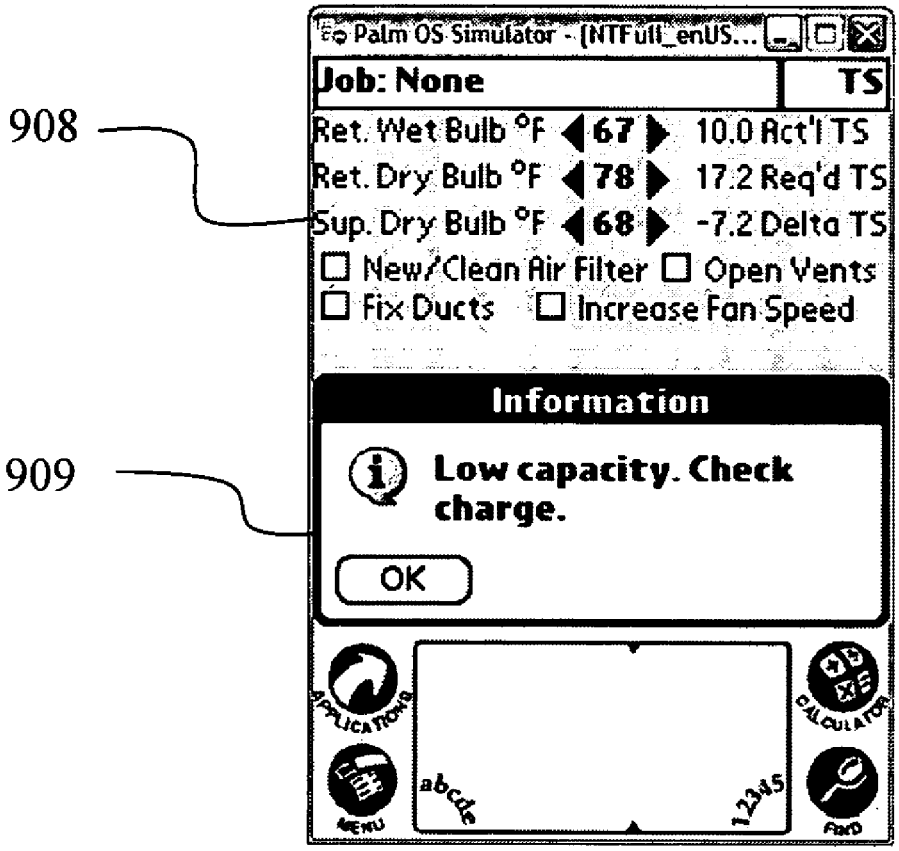

Still referring to FIG. 4, when airflow has been verified the technician may be prompted to check superheat or subcooling, or if those are OK, then all measurements may be saved and the system may report a "verified refrigerant charge and airflow" condition (box 3.1.10). Alternatively, if the delta temperature split is NOT within about ±3° F., then the system checks whether delta temperature split is less than about −3° F. (box 3.1.11). If YES, the system may report a "low capacity check refrigerant charge" condition (box 3.1.12). The system may then prompt the technician to check superheat or subcooling (box 3.1.13). FIG. 9C illustrates the display of a PDAES using yet another leaving (supply) air dry-bulb temperature 909. In this example, the delta temperature split is not within the prescribed limits (at −7.2) and the PDAES displays the following information to advise the technician. "Low Capacity. Check Charge." See 909.

Conversely, if a delta temperature split is greater than +3° F. (box 3.1.14), the system may report a "increase airflow" condition (box 3.1.15). The system then prompts the technician with a checklist of actions intended to improve airflow, such as: clean/replace filter; open airflow vents; clear airflow obstructions; increase fan speed; and repair/replace duct system (box 3.1.16, items 3.1.16.1 et seq). After completing these repair procedures, the technician may be prompted to return to the start of the airflow temperature split procedure and continue, for example box 3.1.2. FIG. 9B illustrates the display of a PDA using a different leaving (supply) air dry-bulb temperature 906. In this example, the delta temperature split is not within the prescribed limits (at +6.8) and the PDA displays the following information to advise the technician. "Increase airflow. Clean filter. Open vents." See 907.

Still referring to FIG. 4, when airflow is verified the technician may be prompted to check superheat or subcooling, or if these are OK, then all measurements may be saved and the system may report a "verified refrigerant charge and airflow" condition (box 3.1.10).

Figure 5:
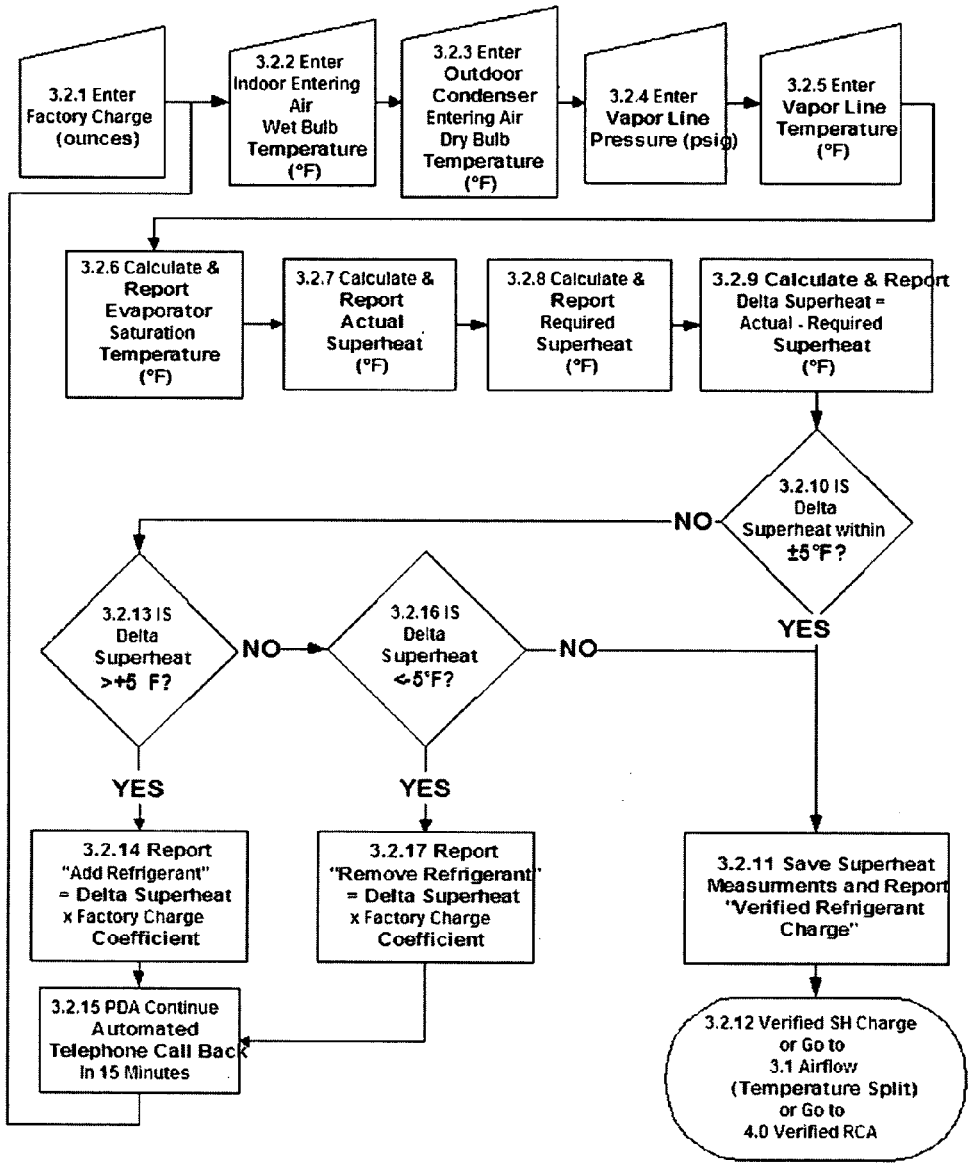
FIG. 5 is a superheat algorithm flowchart diagram.

FIG. 5 provides a superheat algorithm flowchart diagram illustrating the measurements entered into a PDAES or TES and used by software algorithms to diagnose proper refrigerant charge for air conditioning systems with FXV (fixed expansion valve) devices. The flow chart shows the procedural steps to diagnose and correct refrigerant charge as described supra to provide optimal cooling capacity and energy efficiency for operational air-conditioning systems such as that of FIG. 1.

Referring to FIG. 5, in box 3.2.1, the PDAES or TES system prompts the technician to enter factory charge, for example in pounds or ounces (if not already entered, for example, along with the job data). To begin the superheat procedure, the technician enters indoor entering air wet bulb temperature, for example in ° F. (degrees Fahrenheit) (box 3.2.2), outdoor condenser entering air dry bulb temperature also ° F. (box 3.2.3), vapor line pressure in psig (pounds per square inch gauge) (box 3.2.4), and vapor line temperature, ° F. (box 3.2.5). The TES and PDAES may use these data to calculate and report evaporator saturation temperature (box 3.2.6), actual superheat ° F. (box 3.2.7), required superheat ° F. (box 3.2.8), and delta superheat ° F., equal to the actual minus required superheat temperature ° F. (box 3.2.9). The evaporator saturation temperature may be calculated using the vapor line temperature as the independent variable and a temperature and pressure look-up table for refrigerants R22 and R410a. An example of such a table is seen in 16A-16P.

The PDAES or TES checks to see if the delta superheat temperature is within a wider range, typically ±5° F. (box 3.2.10). If the delta superheat temperature is within (for example) ±5° F., then the system may save superheat temperature measurements and report a "verified refrigerant charged" condition (box 3.2.11). When refrigerant charge has been verified the technician may be prompted to continue with airflow temperature split procedures (described supra), or if already verified then all measurements may be saved and the system may report a "verified refrigerant charge and airflow" condition (box 3.2.12).

Figure 10A:
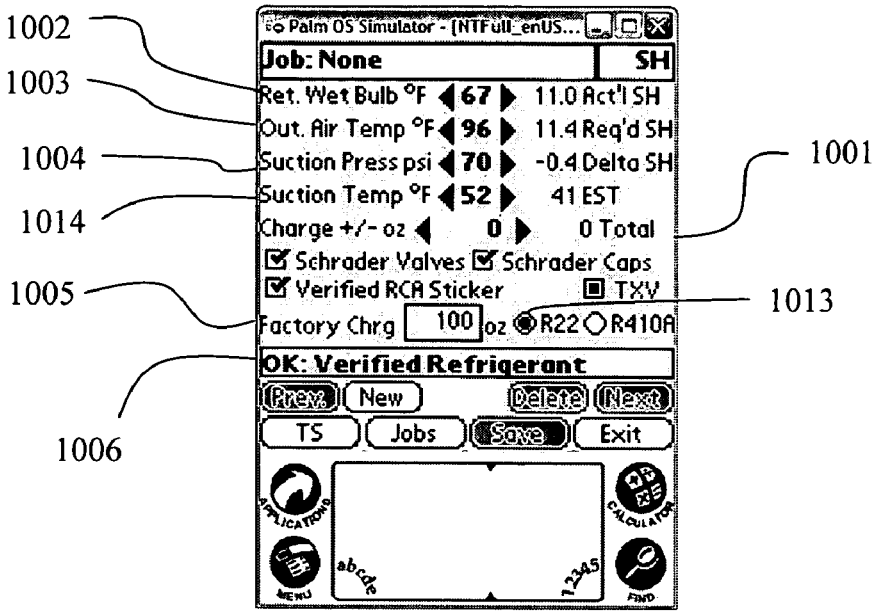
FIGS. 10A-C are PDA displays of the superheat portion according to some embodiments of the present invention.

FIG. 10A illustrates the superheat display 901 of a PDA running software according to some embodiments of the present invention. The entered indoor entering air wet bulb temperature 1002, the outdoor condenser entering air dry bulb temperature 1003, vapor line pressure 1004, and the vapor line temperature 1014 are seen on the display. Also seen on the display are the actual superheat, the required superheat, and the delta superheat. The factory charge 1105, and the refrigerant type 1013 are also seen on the display. In the illustrative example of FIG. 10A, the delta superheat is within bounds and the display indicates that the refrigerant level is verified 1006.

Still referring to FIG. 5, if the delta superheat temperature is NOT within ±5° F., then the system checks whether delta superheat temperature is greater than +5° F. (box 3.2.13). If YES, the system uses algorithms to recommend "add refrigerant" (box 3.2.14), and states the amount of refrigerant to add. The system then prompts the technician to continue and check superheat again after a period such as 15 minutes to allow for the air conditioner to reach equilibrium with the refrigerant charge adjustment (box 3.2.15).

Alternatively, if delta superheat temperature is less than −5° F. (box 3.2.16), the system uses algorithms to recommend "remove refrigerant charge", for example in an amount equal to delta superheat times "coefficient-SH2 times factory charge (box 3.2.17). The system then prompts the technician to continue and check superheat again after say 15 minutes to allow for the air conditioner to reach equilibrium with the refrigerant charge adjustment (box 3.2.15). When refrigerant charge has been verified the technician may be prompted to continue with airflow temperature split procedures (described supra), or if already verified then all measurements may be saved and the system may report a "verified refrigerant charge and airflow" condition (box 3.2.12).

In some embodiments, the system calculates the amount of refrigerant to add based on the inputs listed above using a computer program in conjunction with stored data. The evaporator saturation temperature may be calculated using the vapor line temperature as the independent variable and a temperature and pressure look-up table for refrigerants R22 and R410a. An example of such a table is seen in FIGS.

16A-16P. In some embodiments, the computer program interpolates the evaporator temperature based upon the vapor line pressure for values in between values in the table. Once the evaporator saturation temperature is determined, the actual superheat temperature is determined by subtracting the evaporator saturation temperature from the vapor line temperature.

The required superheat temperature is determined from a data table stored in the computer system in some embodiments. An example of such a table is seen in FIGS. 15A-15B. Using the indoor entering air wet-bulb temperature and the outdoor condenser entering air dry-bulb temperature, the required superheat is derived. The delta superheat is derived by subtracting the required superheat from the delta superheat.

Figure 10B:
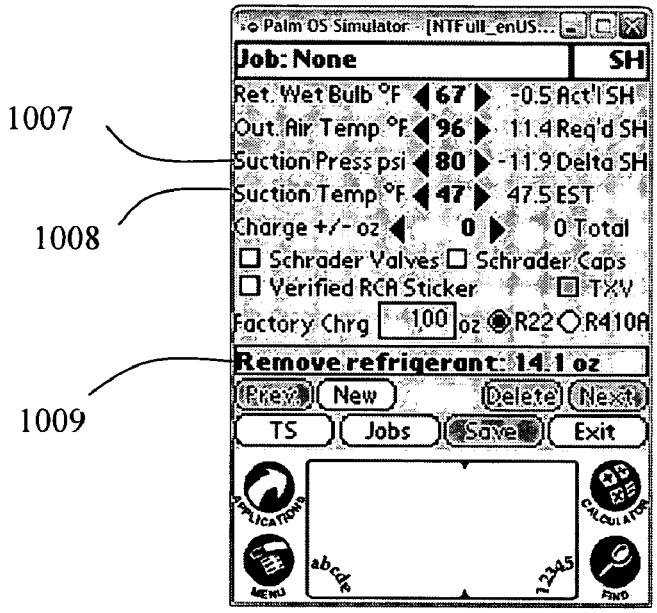
Figure 10C:
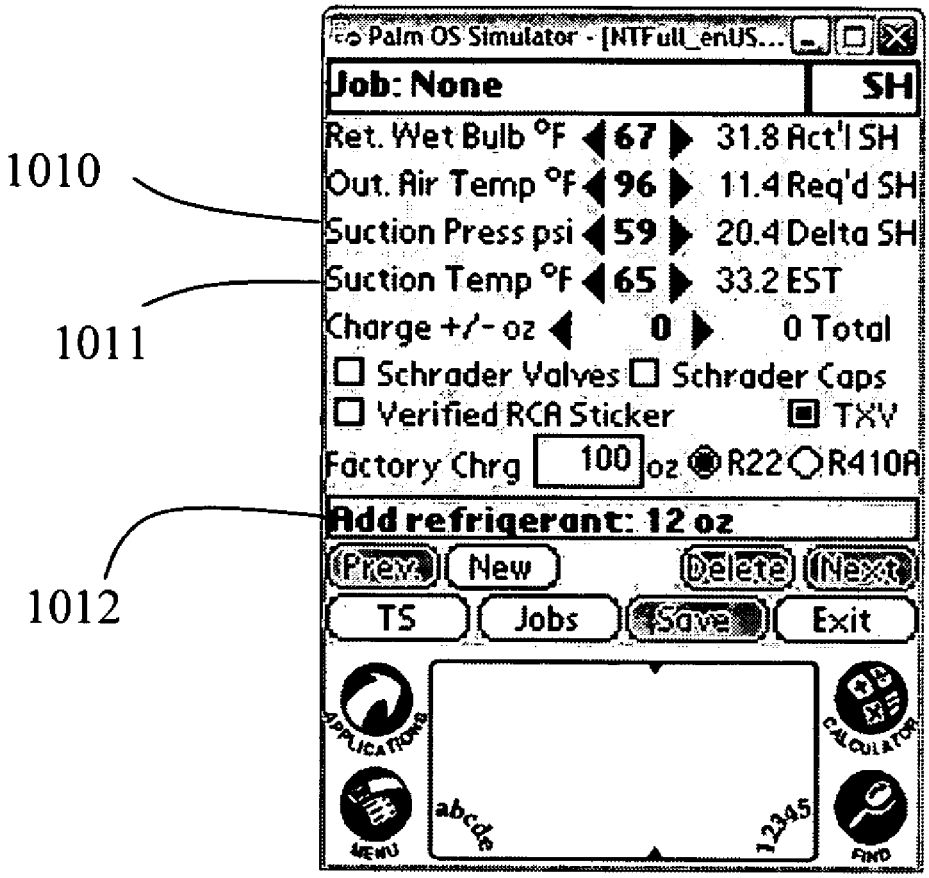

If the delta superheat is within plus or minus 5 degrees (typical), or the pre-determined range, the system is operating with the appropriate amount of refrigerant. If the delta superheat is greater than 5 degrees, the system calculates the amount of refrigerant to be added. An example of a PDA display in such a circumstance is seen in FIG. 10C. If the delta superheat is less than −5 degrees, the system calculates the amount of refrigerant to be removed. An example of a PDA display in such a case is seen in FIG. 10B.

For cases where the delta superheat is greater than 5 degrees, the superheat factory charge coefficient used is 0.5 if the amount of factory charge is not known. The amount of refrigerant to be added is the delta superheat multiplied by the superheat factory charge coefficient. If the factory charge is known and is between 40 and 1200, then the superheat factory charge coefficient is the factor charge divided by (ø times 109). If the factory charge is less than 40, then the superheat charge coefficient is 0.5. If the factory charge is greater than 1200, then the factory charge coefficient is 1200 divided by (ø times 109). In these examples, ø=1.61803398874989. The amount of refrigerant determined to be added using this method and system allows the proper amount of additional refrigerant to be determined without the need for time consuming iterations.

For cases where the delta superheat is less than −5 degrees, the superheat factory charge coefficient used is 1 if the amount of factory charge is not known. The amount of refrigerant to be removed is the absolute value of the delta superheat multiplied by the superheat factory charge coefficient. If the factory charge is known and is between 40 and 1200, then the superheat factory charge coefficient is the factory charge divided by (ø times 55). If the factory charge is less than 40, then the superheat charge coefficient is 0.5. If the factory charge is greater than 1200, then the factory charge coefficient is 1200 divided by (ø times 55). In these examples, ø=1.61803398874989. ø is a constant determined in part from empirical study. The amount of refrigerant determined to be removed using this method and system allows the proper amount of additional refrigerant to be determined without the need for time consuming iterations.

Figure 6:
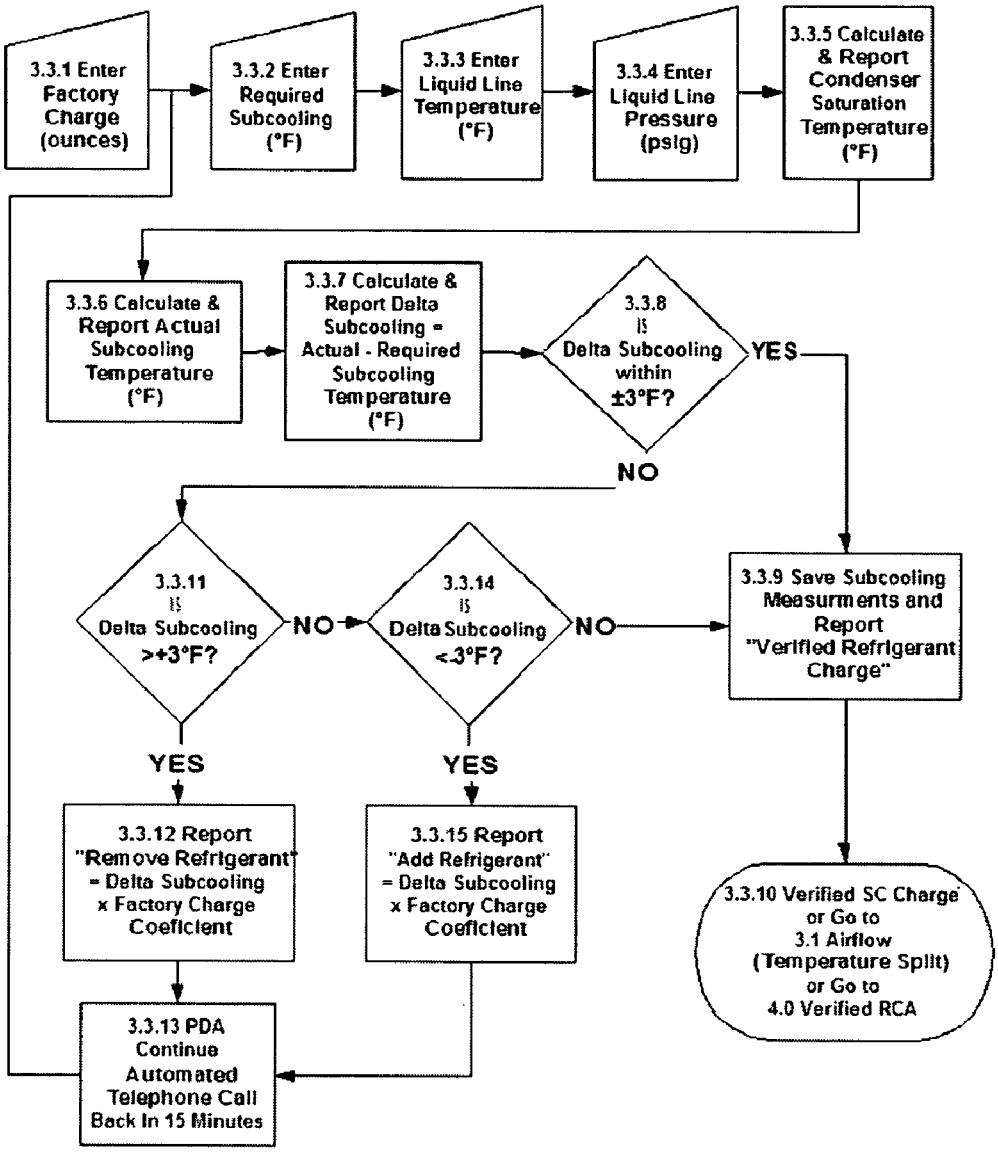
FIG. 6 is a subcooling algorithm flowchart diagram.

FIG. 6 is a subcooling algorithm flowchart diagram illustrating the measurements entered into a PDAES or automated TES and used by the software algorithms to diagnose proper refrigerant charge for air conditioning systems with TXV (thermostatic expansion valve) devices. The flowchart shows procedural steps to diagnose and correct refrigerant charge as described supra to provide optimal cooling capacity and/or energy efficiency for operational air-conditioning systems such as the system of FIG. 1. Modern condensing units are designed to obtain their capacities and efficiencies at a given subcooling value. Any variance from design subcooling will reduce capacity and efficiency.

Still referring to FIG. 6 and box 3.3.1, the PDAES or TES prompts the technician to enter factory charge, typically in ounces (unless already entered with the job data). To begin the subcooling procedure, the technician enters required subcooling temperature, typically in ° F. (degrees Fahrenheit) (box 3.3.2), liquid line temperature, ° F. (box 3.3.3), and liquid line pressure, in psig (box 3.3.4). The required subcooling temperature value is typically found on an information plate on newer cooling devices. The cooling device's service manual may also list the required subcooling temperature. If the required subcooling temperature is unavailable, a default value of 10 F may be used for standard efficiency and 15 F for 12 SEER or above.

Figure 11A:
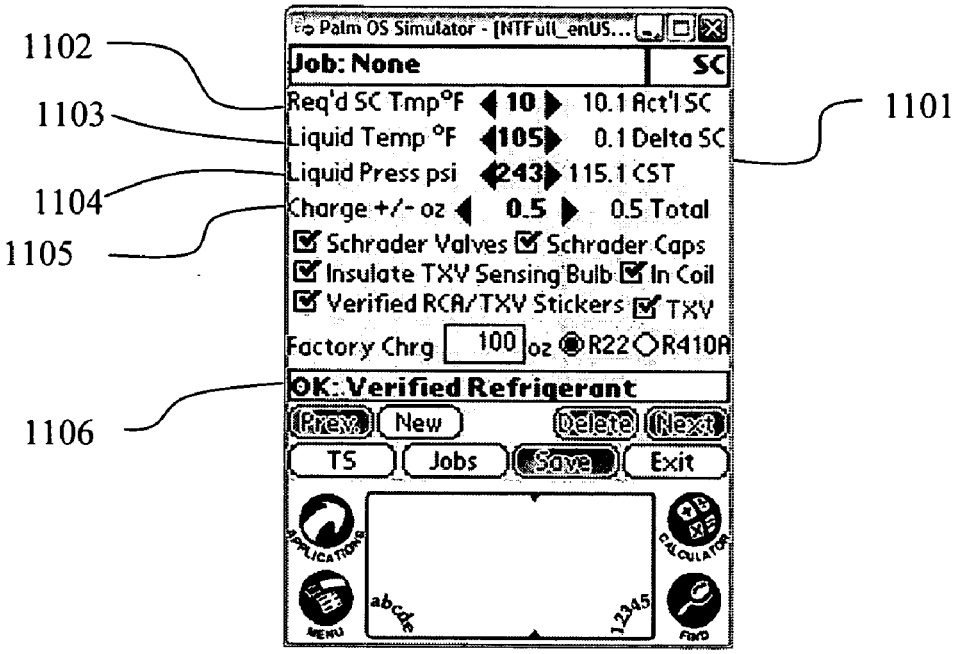
FIGS. 11A-C are PDA displays of the subcooling portion according to some embodiments of the present invention.

FIG. 11A illustrates a PDA screen 1101 seen while diagnosing a TXV device using the subcooling portion of the present invention. The required subcooling temperature 1102, the liquid line temperature 1103, and the liquid line pressure 1104 have all been entered and can be seen on the display. The PDAES or TES use these data to calculate and report condenser saturation temperature (box 3.3.5), actual subcooling, ° F. (box 3.3.6), and delta subcooling ° F.

In some embodiments, the system calculates the amount of refrigerant to add based on the inputs listed above using a computer program in conjunction with stored data. The condenser saturation temperature may be calculated using the liquid line temperature as the independent variable and a temperature and pressure look-up table for refrigerants R22 and R410a. An example of such a table is seen in FIGS. 16A-16P. In some embodiments, the computer program interpolates the condenser saturation temperature based upon the liquid line pressure for values in between values in the table. Once the condenser saturation temperature is determined, the actual subcooling temperature is determined by subtracting the liquid line temperature from the condenser saturation temperature. The delta subcooling may be calculated as equal to the actual subcooling temperature minus required subcooling temperature ° F. (box 3.3.7).

Next, the PDAES or TES may check to see if the delta subcooling temperature is within a range of, typically, ±3° F. (box 3.3.8). If the delta subcooling temperature is within ±3° F., then the system may save subcooling temperature measurements and may report a "verified refrigerant charged" condition (box 3.3.9). An example of such a case 1106 is seen in FIG. 11A. When refrigerant charge is verified the technician is prompted to go to airflow temperature split, or if that is already verified, then all measurements may be saved and the may system report a "verified refrigerant charge and airflow" condition (box 3.3.10).

Figure 11B:
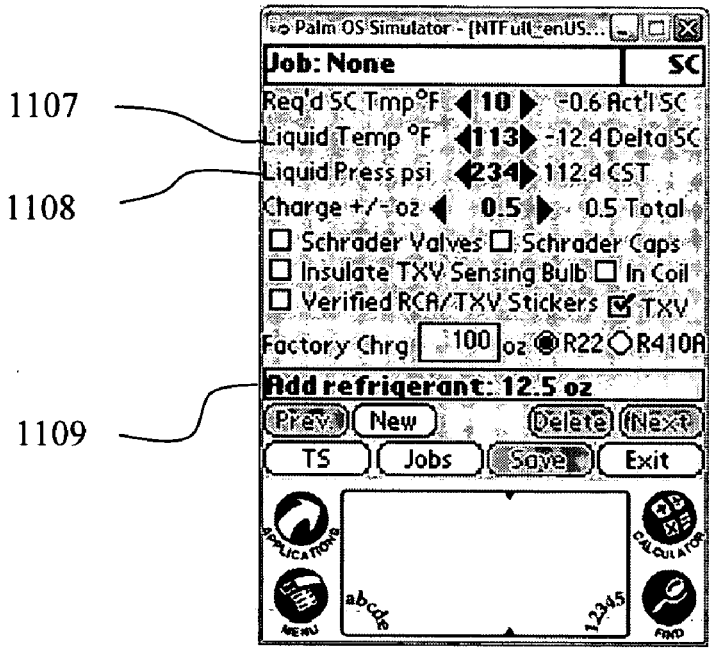
Figure 11C:
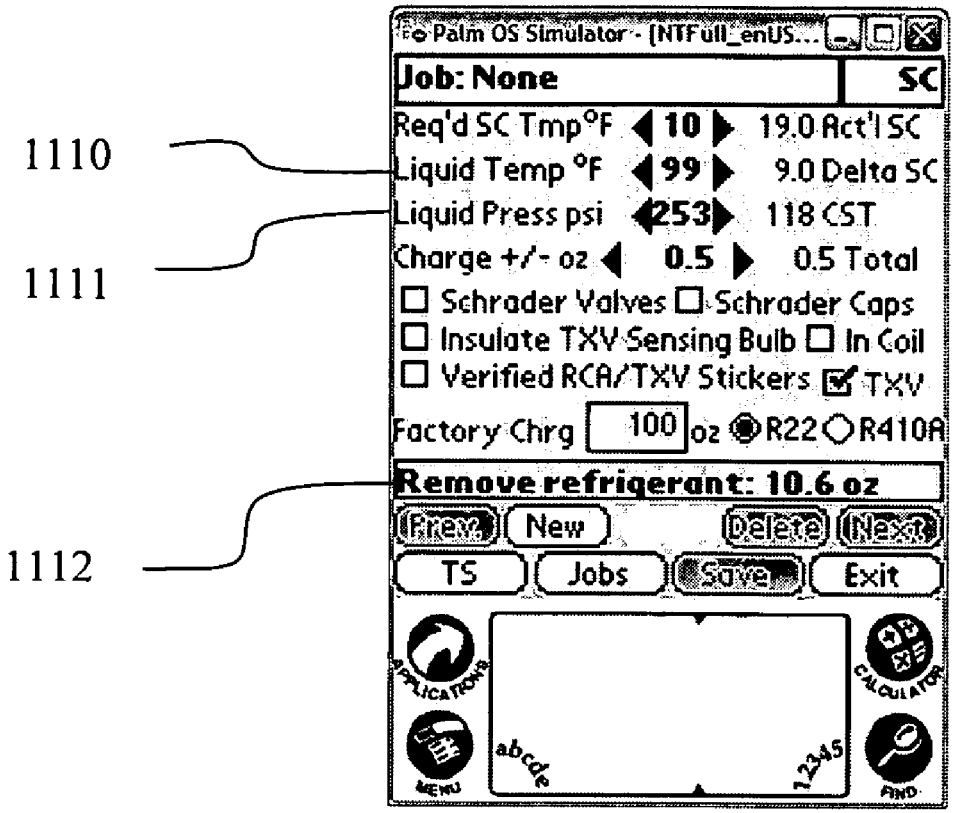

Alternatively, if the delta subcooling temperature is NOT within ±3° F., then the system may check whether delta subcooling temperature is greater than +3° F. (box 3.3.11). If YES, the system may use algorithms to recommend "remove refrigerant" (box 3.3.12). An example of the liquid line temperature 1110 and the liquid line pressure 1111 in such a case is illustrated in FIG. 11C. For cases where the delta subcooling is greater than +3° F., the amount of refrigerant to be removed is the value of the delta subcooling multiplied by the subcooling factory charge coefficient. The subcooling factory charge coefficient used is 1 if the amount of factory charge is not known. If the factory charge is known and is between 40 and 1200, then the subcooling factory charge coefficient is the factory charge divided by (ø times 55). If the factory charge is less than 40, then the subcooling factory charge coefficient is 0.5. If the factory charge is greater than 1200, then the subcooling factory charge coefficient is 1200 divided by (ø times 55). In these examples, ø=1.61803398874989. ø is a constant determined in part from empirical study. The amount of refrigerant determined to be removed using this method and system allows the proper amount of additional refrigerant to be determined without the need for time consuming iterations.

The amount of refrigerant to be removed 1112 is displayed on the PDA screen. The system then prompts the technician to continue and check subcooling again after perhaps 15 minutes to allow for the air conditioner to reach equilibrium with the refrigerant charge adjustment (box 3.3.13).

If delta subcooling temperature is less than −3° F. (box 3.3.14), the system may use algorithms to recommend "add refrigerant charge" (box 3.3.15). An example of the liquid line temperature 1107 and the liquid line pressure 1108 in such a case is illustrated in FIG. 11B. For cases where the delta subcooling is less than −3° F., the amount of refrigerant to be added is the absolute value of the delta subcooling multiplied by the subcooling factory charge coefficient. The subcooling factory charge coefficient used is 1 if the amount of factory charge is not known. If the factory charge is known and is between 40 and 1200, then the subcooling factory charge coefficient is the factory charge divided by (ø times 55). If the factory charge is less than 40, then the subcooling factory charge coefficient is 0.5. If the factory charge is greater than 1200, then the subcooling factory charge coefficient is 1200 divided by (ø times 55). In these examples, ø=1.61803398874989. ø is a constant determined in part from empirical study. The amount of refrigerant determined to be removed using this method and system allows the proper amount of additional refrigerant to be determined without the need for time consuming iterations.

The amount of refrigerant to be added 1109 is displayed on the PDA screen. The system then prompts the technician to continue and check subcooling again after about 15 minutes to allow for the air conditioner to reach equilibrium with the refrigerant charge adjustment (box 3.2.13). When refrigerant charge is verified the technician is prompted to go to airflow temperature split, or if this is okay, then all measurements are saved and the system reports "verified refrigerant charge and airflow (box 3.3.10).

Figure 7:
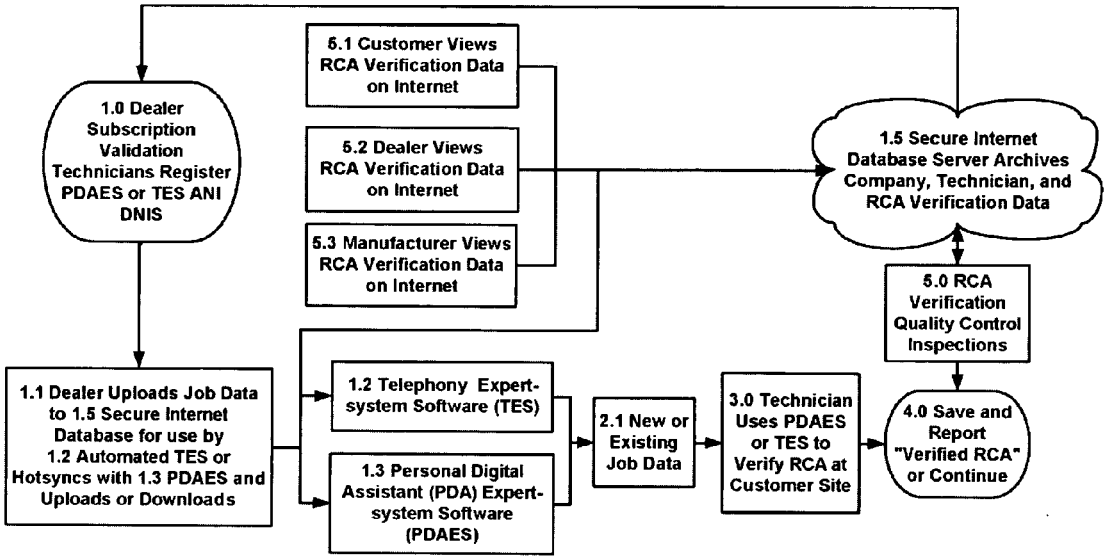
FIG. 7 provides a summary flowchart of RCA Verification automated PDAES and TES such as may be used with embodiments of the invention.

FIG. 7 provides a summary flowchart of RCA Verification automated PDAES (Personal Digital Assistant Expert-system Software) and automated TES (Telephony Expert-system Software) such as may be used with embodiments of the invention. FIG. 7 shows a method used to gather air conditioner refrigerant charge and airflow verification information and report data on the internet database available for viewing by customers, dealers, distributors, and manufacturers.

Still referring to FIG. 7, in box 1.0, the air conditioner dealer subscribes to use the RCA verification system and provides technician and job information. The subscription validation system uses this information to validate technicians using the ANI (Automatic Number Identification) or DNIS (Dialed Number Identification Service) when using the TES (reference 1.2) or PDAES (reference 1.3).

Still referring to FIG. 7 and box 1.1, the dealer uploads air conditioner job data to the Secure Internet Database (box 1.5). Data are uploaded for new or existing jobs (box 2.1). Job data are described in boxes 2.2 through 2.1.17 of FIG. 3. Still referring to FIG. 7 and box 1.2, technicians use the TES or PDAES to verify RCA at the customer site (box 3.0). Airflow temperature split measurements may be entered and diagnosed first. The airflow procedure is described in detail supra in connection with FIG. 4. After the airflow measurements are entered and diagnosed and recommendations are followed, the PDAES or TES are used to verify refrigerant charge (box 3.0). The technician enters data to verify proper refrigerant charge using the superheat or subcooling procedures. These procedures are described in detail in FIGS. 5 and 6.

The refrigerant charge verification procedure diagnoses proper refrigerant charge or recommends the weight of refrigerant to add or remove from the air conditioning system to achieve a balance of saturated refrigerant vapor in the evaporator coil and condenser coil to provide optimal cooling capacity and energy efficiency. Still referring to FIG. 7 and box 4.0, if refrigerant charge and airflow are not verified, the technician continues further diagnostic measurements of superheat and airflow or further diagnostic measurements of subcooling and airflow.

The PDAES and TES save all information entered by technicians regarding measurements and actions taken to verify proper RCA. These data are uploaded to the secure internet database server where data are archived (box 1.5). RCA verification quality control inspections are performed on a statistical random sample of jobs completed by each technician such as for quality assurance purposes (box 5.0). Customers, dealers, and manufacturers view RCA verification data stored on the secure internet database server using an internet browser by logging on with a user name and password (boxes 5.1 through 5.3).

FIGS. 12A-D illustrate an example of a cooling system that has been diagnosed and changed to proper working order using a system and method according to some embodiments of the present invention. The cooling system was a 4-ton TXV equipped split-system air conditioner overcharged with 139 ounces of refrigerant, or 35% over the recommended factory charge. The air conditioner used 5.8 kW when overcharged and 4.8 kW when properly charged. The EER increase from 7.1 to 9.7.

Figure 12A:
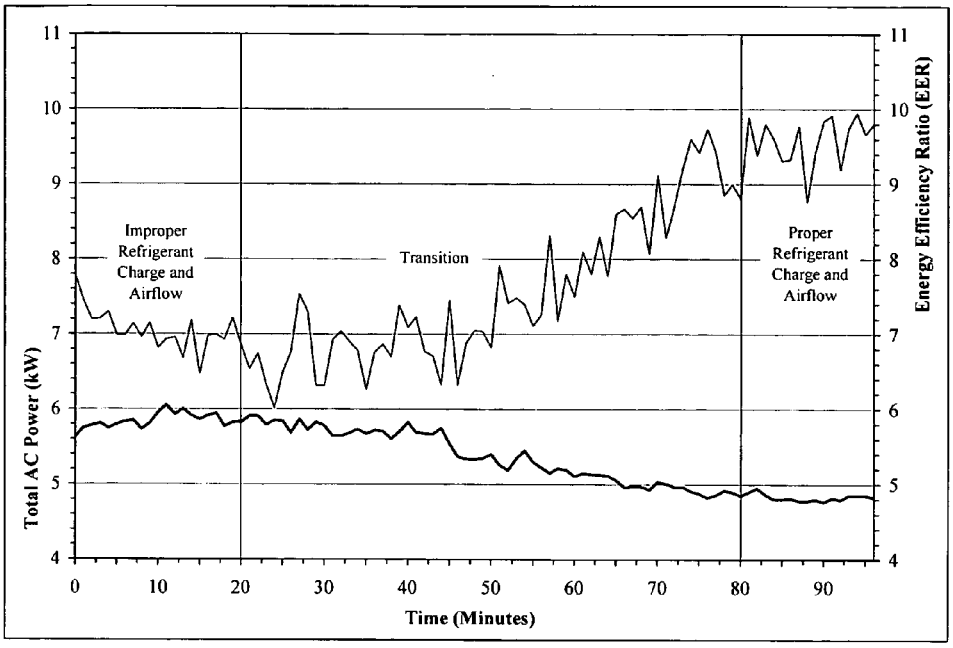
FIGS. 12A-D are illustrative of a test case addressed using an embodiment of the present invention.
Figure 12B:
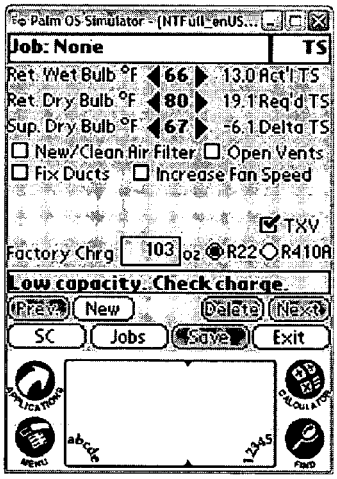
Figure 12C:
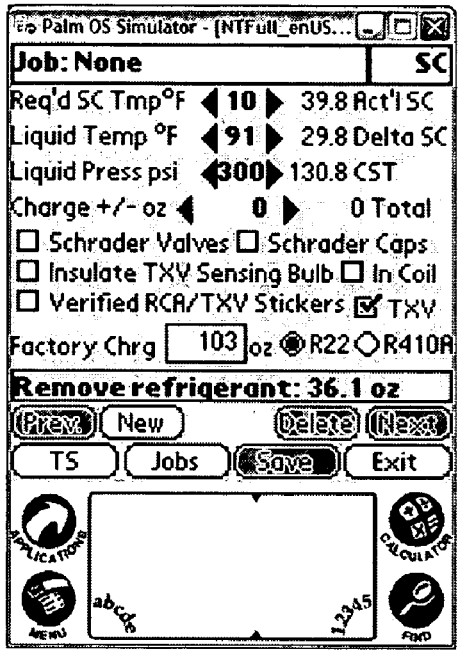
Figure 12D:
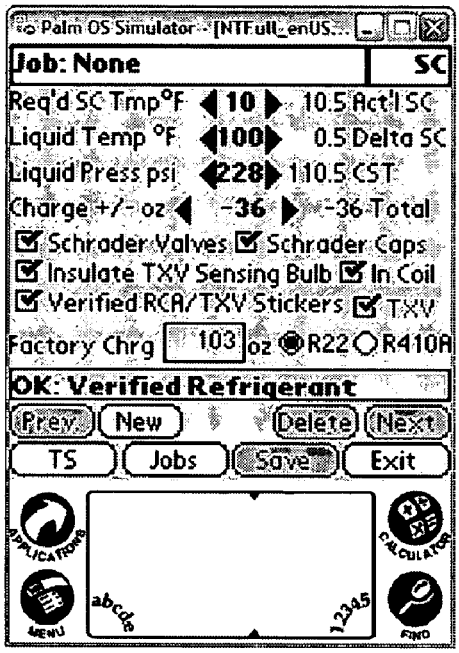

FIGS. 12B-D illustrate the PDA displays of the original readings and again after the recommended refrigerant removal had taken place. The system was operating properly after the recommended removal, without any need for iteration and the extra time associated with iteration.

Figure 13:
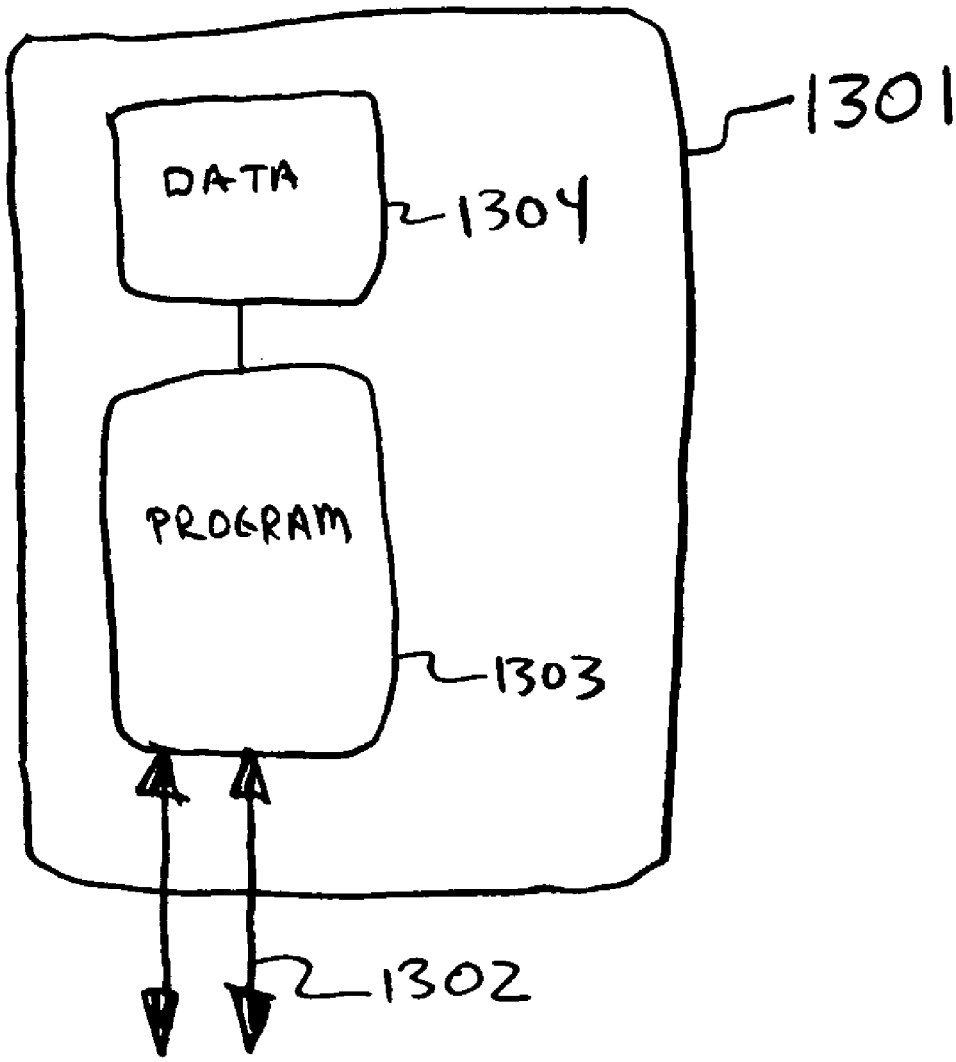
FIG. 13 is an illustrative schematic of a computer according to some embodiments of the present invention.

In some embodiments of the present invention, as seen in FIG. 13, an computer 1301 receives input and gives output via an I/O portion 1302. In some embodiments, the I/O portion 1302 is the screen of a personal digital assistant. In some embodiments, the computer 1301 is a personal digital assistant or other computing device. The computer 1301 contains a computer program 1303 and stored data 1304. In some embodiments, the data is contained within the computer program.

The embodiments described above are exemplary rather than limiting and the bounds of the invention should be determined from the claims. Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

I claim:

1. A method for adjusting a refrigerant charge of an air conditioning system, the method comprising:

computing a delta temperature split;

comparing the delta temperature split to a delta temperature split threshold;

if the absolute value of the delta temperature split is less than the delta temperature split threshold, ending the method;

if the delta temperature split is less than minus the delta temperature split threshold, and the air conditioning system is not a Thermostatic Expansion Valve (TXV) system:

computing one of the a refrigerant undercharge and a refrigerant overcharge based on a superheat temperature;

if the delta temperature split is less than minus the delta temperature split threshold, and the air conditioning system is the TXV system:

computing one of the refrigerant undercharge and the refrigerant overcharge based on subcooling temperature; and adjusting the amount of refrigerant in the air conditioning system based on one of the refrigerant undercharge and the refrigerant overcharge.

2. The method of claim 1, further including, if the delta temperature split is greater than the delta temperature split threshold, reporting a need to increase air flow.

3. The method of claim 1, wherein computing the delta temperature split comprises:

computing an actual temperature split by subtracting the leaving supply air dry bulb temperature from the entering air dry bulb temperature;

obtaining a required temperature split from a lookup table; and computing a delta temperature split from the actual temperature split and the required temperature split.

4. The method of claim 3, wherein computing a delta temperature split from the actual temperature split and the required temperature split comprises computing a delta temperature split by subtracting the required temperature split from the actual temperature split.

5. The method of claim 4, wherein the delta temperature split threshold is approximately three degrees Fahrenheit.

6. The method of claim 1, wherein computing one of the refrigerant undercharge and the refrigerant overcharge based on superheat temperature comprises:

computing an actual superheat temperature from vapor line pressure, vapor line temperature, and evaporator saturation temperature;

obtaining a required superheat temperature from an indoor air wet bulb temperature and an outdoor condenser entering air dry bulb temperature;

computing delta superheat temperature as the actual superheat temperature minus the required superheat temperature;

if an absolute value of the delta superheat temperature is less than a delta superheat temperature threshold, ending the method;

if the delta superheat temperature is greater than the delta superheat temperature threshold:

computing the refrigerant undercharge as the delta superheat temperature times a first superheat factory charge coefficient; and if the delta superheat temperature is less than minus the delta superheat temperature threshold:

computing the refrigerant overcharge as the delta superheat temperature times a second superheat factory charge coefficient.

7. The method of claim 6, wherein computing superheat temperature comprises computing the actual superheat temperature by subtracting the evaporator saturation temperature from the vapor line temperature.

8. The method of claim 7, wherein obtaining a required superheat temperature comprises looking up the required superheat temperature from a required superheat temperature lookup table using the indoor air wet bulb temperature and the outdoor condenser entering air dry bulb temperature.

9. The method of claim 6, wherein:

the first superheat factory charge coefficient is determined as:

if the amount of factory charge is not known, the superheat factory charge coefficient is 0.5;

if the factory charge is known and is between zero and 40, then the superheat charge coefficient is 0.5;

if the factory charge is known and is between 40 and 1200, then the superheat factory charge coefficient is the factory charge divided by (phi times 109); and if the factory charge is known and is greater than 1200, then the superheat factory charge coefficient is 1200 divided by (phi times 109);

the second superheat factory charge coefficient is determined as:

if the amount of factory charge is not known, the superheat factory charge coefficient is 1.0;

if the factory charge is known and is between zero and 40, then the superheat charge coefficient is 0.5;

if the factory charge is known and is between 40 and 1200, then the superheat factory charge coefficient is the factory charge divided by (phi times 55); and If the factory charge is known and is greater than 1200, then the superheat factory charge coefficient is 1200 divided by (phi times 55); and phi is 1.61803398874989.

10. The method of claim 1, wherein computing one of the undercharge and the overcharge based on subcooling temperature comprises:

obtaining a factory charge level;

obtaining a required subcooling temperature;

obtaining a liquid line temperature;

obtaining a liquid line pressure;

calculating condenser saturation temperature;

computing an actual subcooling temperature;

computing a delta subcooling temperature as the actual subcooling temperature minus the required subcooling temperature;

if the absolute value of the delta subcooling temperature is less than a delta subcooling temperature threshold, ending the method;

if the delta subcooling temperature is greater than the delta subcooling temperature threshold:

computing the refrigerant overcharge as the delta subcooling temperature times a subcooling factory charge coefficient; and if the delta subcooling temperature is less than minus the delta subcooling temperature threshold:

computing the refrigerant undercharge as the delta subcooling temperature times the subcooling factory charge coefficient.

11. The method of claim 10, further including computing the actual subcooling temperature by subtracting the liquid line temperature from the condenser saturation temperature.

12. The method of claim 10, wherein the required subcooling temperature is obtained from a required subcooling temperature lookup table.

13. The method of claim 12, wherein obtaining a required subcooling temperature comprises:

measuring an outdoor condenser entering air dry bulb temperature; and looking up the required subcooling temperature in a lookup table using the outdoor condenser entering air dry bulb temperature.

14. The method of claim 10, wherein the subcooling factory charge coefficient is determined as:

if the amount of factory charge is not known, the subcooling factory charge coefficient used is 1;

if the factory charge is between zero and 40, then the subcooling factory charge coefficient is 0.5;

if the factory charge is known and is between 40 and 1200, then the subcooling factory charge coefficient is the factory charge divided by (phi times 55);

if the factory charge is greater than 1200, then the subcooling factory charge coefficient is 1200 divided by (phi times 55); and phi is 1.61803398874989.

15. A method for adjusting a refrigerant charge of a Thermostatic Expansion Valve (TXV) air conditioning system, the method comprising:

obtaining a factory charge level;

obtaining a required subcooling temperature;

obtaining a liquid line temperature;

obtaining a liquid line pressure;

calculating condenser saturation temperature;

computing an actual subcooling temperature;

computing a delta subcooling temperature as the actual subcooling temperature minus the required subcooling temperature;

if the absolute value of the delta subcooling temperature is less than a delta subcooling temperature threshold, ending the method;

if the delta subcooling temperature is greater than the delta subcooling temperature threshold:

computing the refrigerant overcharge as the delta subcooling temperature times a subcooling factory charge coefficient;

removing an amount of refrigerant from the air conditioning system equal to the refrigerant overcharge;

waiting a period of time for the air conditioning system to respond to the change in refrigerant level; and repeating computing the liquid line temperature and following steps;

if the delta subcooling temperature is less than minus the delta subcooling temperature threshold:

computing the refrigerant undercharge as the delta subcooling temperature times the subcooling factory charge coefficient;

adding an amount of refrigerant to the air conditioning system equal to the refrigerant under charge;

waiting the period of time for the air conditioning system to respond to the change in refrigerant level; and repeating obtaining the liquid line temperature and following steps.

16. The method of claim 15, wherein computing an actual subcooling temperature comprises, computing the actual subcooling temperature by subtracting the liquid line temperature from the condenser saturation temperature.

17. The method of claim 15, wherein the required subcooling temperature is obtained from a required subcooling temperature lookup table.

18. The method of claim 17, wherein obtaining the required subcooling temperature comprises:

measuring an outdoor condenser entering air dry bulb temperature; and looking up the required subcooling temperature in a lookup table using the outdoor condenser entering air dry bulb temperature.

19. The method of claim 15, wherein the subcooling factory charge coefficient is determined as:

if the amount of factory charge is not known, the subcooling factory charge coefficient used is 1;

if the factory charge is between zero and 40, then the subcooling factory charge coefficient is 0.5;

if the factory charge is known and is between 40 and 1200, then the subcooling factory charge coefficient is the factory charge divided by (phi times 55);

if the factory charge is greater than 1200, then the subcooling factory charge coefficient is 1200 divided by (phi times 55); and phi is 1.61803398874989.

20. A method for adjusting a refrigerant charge of a non-Thermostatic Expansion Valve (TXV) air conditioning system, the method comprising:

computing an actual superheat temperature from vapor line pressure, vapor line temperature, and evaporator saturation temperature;

obtaining a required superheat temperature;

computing a delta superheat temperature as the actual superheat temperature minus the required superheat temperature;

if an absolute value of the delta superheat temperature is less than a delta superheat temperature threshold, ending the method;

if the delta superheat temperature is greater than the delta superheat temperature threshold:

computing the refrigerant undercharge as the delta superheat temperature times a first superheat factory charge coefficient;

adding an amount of refrigerant equal to the refrigerant undercharge to the air conditioning system;

waiting a period of time for the air conditioning system to respond to the change in refrigerant level; and repeating computing the actual superheat temperature and following steps;

if the delta superheat temperature is less than minus the delta superheat temperature threshold:

computing the refrigerant overcharge as the delta superheat temperature times a second superheat factory charge coefficient;

removing an amount of refrigerant equal to the refrigerant overcharge from the air conditioning system;

waiting a period of time for the air conditioning system to respond to the change in refrigerant level; and repeating computing the actual superheat temperature and following steps.

21. The method of claim 20, wherein the superheat factory charge coefficient is determined as:

the first superheat factory charge coefficient is determined as:

if the amount of factory charge is not known, the superheat factory charge coefficient is 0.5;

if the factory charge is known and is between zero and 40, then the superheat charge coefficient is 0.5;

if the factory charge is known and is between 40 and 1200, then the superheat factory charge coefficient is the factory charge divided by (phi times 109); and If the factory charge is known and is greater than 1200, then the superheat factory charge coefficient is 1200 divided by (phi times 109);

the second superheat factory charge coefficient is determined as:

if the amount of factory charge is not known, the superheat factory charge coefficient is 1.0;

if the factory charge is known and is between zero and 40, then the superheat charge coefficient is 0.5;

if the factory charge is known and is between 40 and 1200, then the superheat factory charge coefficient is the factory charge divided by (phi times 55); and If the factory charge is known and is greater than 1200, then the superheat factory charge coefficient is 1200 divided by (phi times 55); and phi is 1.61803398874989.

22. The method of claim 20, wherein computing superheat temperature comprises computing the actual superheat temperature by subtracting the evaporator saturation temperature from the vapor line temperature.

23. The method of claim 20, wherein obtaining a required superheat temperature comprises looking up the required superheat temperature from a required superheat temperature lookup table using the indoor air wet bulb temperature and the outdoor condenser entering air dry bulb temperature.

24. A method for adjusting a refrigerant charge of an Thermostatic Expansion Valve (TXV) air conditioning system, the method comprising:

obtaining a factory charge level;

obtaining a required subcooling temperature;

measuring a single liquid line temperature;

measuring a single condenser saturation temperature;

computing an actual superheat temperature by subtracting the single liquid line temperature measurement from the single condenser saturation temperature measurement;

computing a delta subcooling temperature as the actual subcooling temperature minus the required subcooling temperature;

if the absolute value of the delta subcooling temperature is less than a delta subcooling temperature threshold, ending the method;

if the delta subcooling temperature is greater than the delta subcooling temperature threshold:

computing the refrigerant overcharge as the delta subcooling temperature times a subcooling factory charge coefficient;

removing an amount of refrigerant from the air conditioning system equal to the refrigerant overcharge;

waiting a period of time for the air conditioning system to respond to the change in refrigerant level; and repeating obtaining the single liquid line temperature and following steps;

if the delta subcooling temperature is less than minus the delta subcooling temperature threshold:

computing the refrigerant undercharge as the delta subcooling temperature times the subcooling factory charge coefficient;

adding an amount of refrigerant to the air conditioning system equal to the refrigerant under charge;

waiting the period of time for the air conditioning system to respond to the change in refrigerant level; and repeating obtaining the single liquid line temperature and following steps.

25. A method for adjusting a refrigerant charge of a non-Thermostatic Expansion Valve (TXV) air conditioning system, the method comprising:

measuring a single evaporator saturation temperature;

measuring a single vapor line temperature;

computing the actual superheat temperature by subtracting the single evaporator saturation temperature measurement from the single vapor line temperature measurement;

obtaining a required superheat temperature;

computing a delta superheat temperature as the actual superheat temperature minus the required superheat temperature;

if an absolute value of the delta superheat temperature is less than a delta superheat temperature threshold, ending the method;

if the delta superheat temperature is greater than the delta superheat temperature threshold:

computing the refrigerant undercharge as the delta superheat temperature times a superheat factory charge coefficient;

adding an amount of refrigerant equal to the refrigerant undercharge to the air conditioning system;

waiting a period of time for the air conditioning system to respond to the change in refrigerant level; and repeating computing the actual superheat temperature and following steps;

if the delta superheat temperature is less than minus the delta superheat temperature threshold:

computing the refrigerant overcharge as the delta superheat temperature times the superheat factory charge coefficient;

removing an amount of refrigerant equal to the refrigerant overcharge from the air conditioning system;

waiting a period of time for the air conditioning system to respond to the change in refrigerant level; and repeating computing the actual superheat temperature and following steps.

* * * * *